US011636845B2

(12) United States Patent
Yang et al.

(10) Patent No.: US 11,636,845 B2
(45) Date of Patent: Apr. 25, 2023

(54) METHOD FOR SYNTHESIZED SPEECH GENERATION USING EMOTION INFORMATION CORRECTION AND APPARATUS

(71) Applicant: LG ELECTRONICS INC., Seoul (KR)

(72) Inventors: Siyoung Yang, Seoul (KR); Yongchul Park, Seoul (KR); Sungmin Han, Seoul (KR); Sangki Kim, Seoul (KR); Juyeong Jang, Seoul (KR); Minook Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 268 days.

(21) Appl. No.: 16/928,815

(22) Filed: Jul. 14, 2020

(65) Prior Publication Data

US 2021/0074261 A1 Mar. 11, 2021

(30) Foreign Application Priority Data

Sep. 6, 2019 (KR) ..... 10-2019-0111052

(51) Int. Cl.
*G10L 13/00* (2006.01)
*G10L 13/08* (2013.01)
(Continued)

(52) U.S. Cl.
CPC ..... *G10L 13/10* (2013.01); *G10L 13/00* (2013.01); *G10L 13/033* (2013.01); *G10L 13/04* (2013.01)

(58) Field of Classification Search
CPC ..... G10L 25/63; G10L 13/033; G10L 19/04; G10L 21/003; G10L 21/02; G10L 13/02;
(Continued)

(56) References Cited

U.S. PATENT DOCUMENTS 8,321,225 B1 * 11/2012 Jansche ..... G10L 13/027 704/263
2013/0054244 A1 * 2/2013 Bao ..... G10L 13/02 704/260

(Continued)

FOREIGN PATENT DOCUMENTS

CN 112289299 A * 1/2021
CN 113611283 A * 11/2021

OTHER PUBLICATIONS

Reddy, M. Gurunath, et al. "Telugu emotional story speech synthesis using SABLE markup language." 2015 International Conference on Signal Processing and Communication Engineering Systems. IEEE, 2015. (Year: 2015).*

(Continued)

*Primary Examiner* — Michael Ortiz-Sanchez
(74) *Attorney, Agent, or Firm* — Fish & Richardson P.C.

(57) ABSTRACT

A method includes generating first synthesized speech by using text and a first emotion vector configured for the text, extracting a second emotion vector included in the first synthesized speech, determining whether correction of the second emotion information vector is needed by comparing a loss value calculated by using the first emotion information vector and the second emotion information vector with a preconfigured threshold, re-performing speech synthesis by using a third emotion information vector generated by correcting the second emotion information vector, and outputting the generated synthesized speech, thereby configuring emotion information of speech in a more effective manner. A speech synthesis apparatus may be associated with an artificial intelligence module, drone (unmanned aerial vehicle, UAV), robot, augmented reality (AR) devices, virtual reality (VR) devices, devices related to 5G services, and the like.

13 Claims, 15 Drawing Sheets

(51) Int. Cl.

| | |
|---|---|
| ***G10L 13/10*** | (2013.01) |
| ***G10L 13/033*** | (2013.01) |
| *G10L 13/04* | (2013.01) |

(58) Field of Classification Search

CPC ..... G10L 13/00; G10L 13/04; G10L 13/08; G10L 2013/083; G10L 13/10; G10L 13/027; G10L 25/30; G10L 13/047; G10L 13/0335; G10L 19/0017; G10L 19/0018; G06F 40/30; G06F 40/56; G06F 40/35; G10K 15/02

See application file for complete search history.

(56) References Cited

U.S. PATENT DOCUMENTS

| | | | | |
|---|---|---|---|---|
| 2018/0077095 | A1* | 3/2018 | Deyle | G06T 13/205 |
| 2019/0318722 | A1* | 10/2019 | Bromand | G10L 13/02 |
| 2020/0218781 | A1* | 7/2020 | Takano | G06Q 30/016 |

OTHER PUBLICATIONS

Matsumoto, Kento, Sunao Hara, and Masanobu Abe. "Speech-like Emotional Sound Generator by WaveNet." 2019 Asia-Pacific Signal and Information Processing Association Annual Summit and Conference (APSIPA ASC). IEEE, 2019. (Year: 2019).*

* cited by examiner

<Training>

<Training>

<Inference>

METHOD FOR SYNTHESIZED SPEECH GENERATION USING EMOTION INFORMATION CORRECTION AND APPARATUS

This application claims the benefit of Korean Patent Application No. 10-2019-0111052, filed on Sep. 6, 2019, which is incorporated herein by reference for all purposes as if fully set forth herein.

TECHNICAL FIELD

The present disclosure relates to a method for generating synthesized speech using emotion information correction and, more particularly, to a method for correcting emotion information of synthesized speech by using a deep-learning model and apparatus for the method.

BACKGROUND

Up to now, methods for generating synthesized speech employing text and emotion information as inputs have been commonly used. However, a drawback of such methods is that it is not possible to verify whether synthesized speech has been generated to reflect emotion information applied as an input.

Therefore, needs for verifying whether emotion information desired by a user is duly expressed in generating synthesized speech and for generating synthesized speech including the emotion information desired by the user are growing.

SUMMARY

An object of the present disclosure is to solve the aforementioned necessity and/or problems.

Also, an object of the present disclosure is to provide a method for checking emotion contained in synthesized speech generated based on text and emotion information and correcting the emotion.

Also, an object of the present disclosure is to regenerate synthesized speech based on corrected emotion.

In a method for generating synthesized speech according to one embodiment of the present disclosure, the method comprises generating first synthesized speech by using text and a first emotion vector configured for the text; extracting a second emotion vector included in the first synthesized speech; determining whether correction of the second emotion information vector is needed by comparing a loss value calculated by using the first emotion information vector and the second emotion information vector with a preconfigured threshold; if a loss value calculated by using the first emotion information vector and the second emotion information vector exceeds a preconfigured threshold, generating a third emotion information vector by correcting the second emotion information vector based on the first emotion information vector and generating second synthesized speech by using the third emotion information vector; and outputting the second synthesized speech, wherein the loss value calculated by using the first emotion information vector and an emotion information vector included in the second synthesized speech may be less than the preconfigured threshold.

If the loss value calculated by using the first emotion information vector and the second emotion information vector is less than the preconfigured threshold, the method may further comprise outputting the first synthesized speech.

The loss value calculated by using the first emotion information vector and the second emotion information vector may be a value calculated based on a difference between the first emotion information vector and the second emotion information vector; and the loss value calculated by using the first emotion information vector and an emotion information vector included in the second synthesized speech may be a value calculated based on a difference between the first emotion information vector and the emotion information vector included in the second synthesized speech.

The loss value calculated by using the first emotion information vector and the emotion information vector included in the second synthesized speech may be 0.

The loss value calculated by using the first emotion information vector and the second emotion information vector may be a value calculated based on the square of a difference between the first emotion information vector and the second emotion information vector; and the loss value calculated by using the first emotion information vector and an emotion information vector included in the second synthesized speech may be a value calculated based on the square of a difference between the first emotion information vector and an emotion information vector included in the second synthesized speech.

The third emotion information vector may be generated by using a deep learning model.

The deep learning model may be a model performing deep learning by using the first emotion information vector, second emotion information vector, and third emotion information vector.

In apparatus for generating synthesized speech according to another embodiment of the present disclosure, the apparatus comprises an input unit receiving text and a first emotion information vector configured for the text; an output unit outputting synthesized speech; and a processor functionally connected to the input unit and the output unit, wherein the processor is configured to generate first synthesized speech by using the text and a first emotion vector configured for the text; extract a second emotion vector included in the first synthesized speech; determine whether correction of the second emotion information vector is needed by comparing a loss value calculated by using the first emotion information vector and the second emotion information vector with a preconfigured threshold; if a loss value calculated by using the first emotion information vector and the second emotion information vector exceeds a preconfigured threshold, generate a third emotion information vector by correcting the second emotion information vector based on the first emotion information vector; and generate second synthesized speech by using the third emotion information vector, wherein the loss value calculated by using the first emotion information vector and an emotion information vector included in the second synthesized speech may be less than the preconfigured threshold, and the synthesized speech may be the second synthesized speech.

If the loss value calculated by using the first emotion information vector and the second emotion information vector is less than the preconfigured threshold, the synthesized speech may be the first synthesized speech.

The loss value calculated by using the first emotion information vector and the second emotion information vector may be a value calculated based on a difference between the first emotion information vector and the second emotion information vector; and the loss value calculated by using the first emotion information vector and an emotion information vector included in the second synthesized speech may be a value calculated based on a difference between the first emotion information vector and an emotion information vector included in the second synthesized speech.

The loss value calculated by using the first emotion information vector and an emotion information vector included in the second synthesized speech may be 0.

The loss value calculated by using the first emotion information vector and the second emotion information vector may be a value calculated based on the square of a difference between the first emotion information vector and the second emotion information vector; and the loss value calculated by using the first emotion information vector and an emotion information vector included in the second synthesized speech may be a value calculated based on the square of a difference between the first emotion information vector and an emotion information vector included in the second synthesized speech.

The third emotion information vector may be generated by using a deep learning model.

The deep learning model may be a model performing deep learning by using the first emotion information vector, second emotion information vector, and third emotion information vector.

According to yet another embodiment of the present disclosure, an electronic device may comprise one or more processors; a memory; and one or more programs, wherein the one or more programs may be configured to be stored in the memory and to be executed by the one or more processors; and the one or more programs may include commands for performing a method for generating synthesized speech.

BRIEF DESCRIPTION OF THE DRAWINGS

Accompanying drawings included as a part of the detailed description for helping understand the present disclosure provide embodiments of the present disclosure and are provided to describe technical features of the present disclosure with the detailed description.

DETAILED DESCRIPTION

Hereinafter, embodiments of the disclosure will be described in detail with reference to the attached drawings. The same or similar components are given the same reference numbers and redundant description thereof is omitted. The suffixes "module" and "unit" of elements herein are used for convenience of description and thus can be used interchangeably and do not have any distinguishable meanings or functions. Further, in the following description, if a detailed description of known techniques associated with the present disclosure would unnecessarily obscure the gist of the present disclosure, detailed description thereof will be omitted. In addition, the attached drawings are provided for easy understanding of embodiments of the disclosure and do not limit technical spirits of the disclosure, and the embodiments should be construed as including all modifications, equivalents, and alternatives falling within the spirit and scope of the embodiments.

While terms, such as "first", "second", etc., may be used to describe various components, such components must not be limited by the above terms. The above terms are used only to distinguish one component from another.

When an element is "coupled" or "connected" to another element, it should be understood that a third element may be present between the two elements although the element may be directly coupled or connected to the other element. When an element is "directly coupled" or "directly connected" to another element, it should be understood that no element is present between the two elements.

The singular forms are intended to include the plural forms as well, unless the context clearly indicates otherwise.

In addition, in the disclosure, it will be further understood that the terms "comprise" and "include" specify the presence of stated features, integers, steps, operations, elements, components, and/or combinations thereof, but do not preclude the presence or addition of one or more other features, integers, steps, operations, elements, components, and/or combinations.

Hereinafter, 5G communication (5th generation mobile communication) required by an apparatus requiring AI processed information and/or an AI processor will be described through paragraphs A through G.

A. Example of Block Diagram of UE and 5G Network

Figure 1:
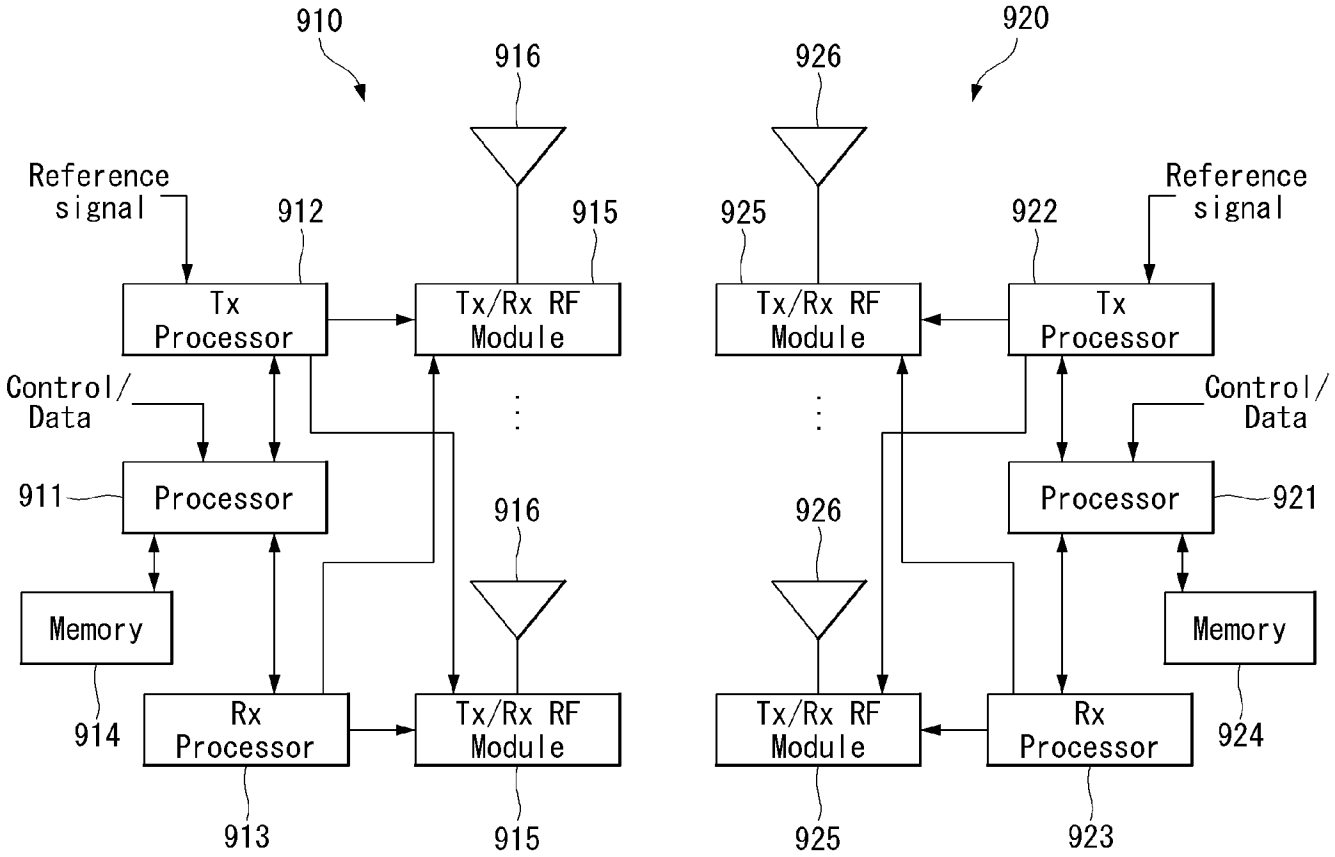
FIG. 1 is a block diagram of a wireless communication system to which methods proposed in the disclosure are applicable.

FIG. 1 is a block diagram of a wireless communication system to which methods proposed in the disclosure are applicable.

Referring to FIG. 1, a device (AI device) including an AI module is defined as a first communication device (910 of FIG. 1), and a processor 911 can perform detailed AI operation.

A 5G network including another device (AI server) communicating with the AI device is defined as a second communication device (920 of FIG. 1), and a processor 921 can perform detailed AI operations.

The 5G network may be represented as the first communication device and the AI device may be represented as the second communication device.

For example, the first communication device or the second communication device may be a base station, a network node, a transmission terminal, a reception terminal, a wireless device, a wireless communication device, an autonomous device, or the like.

For example, the first communication device or the second communication device may be a base station, a network node, a transmission terminal, a reception terminal, a wireless device, a wireless communication device, a vehicle, a vehicle having an autonomous function, a connected car, a drone (Unmanned Aerial Vehicle, UAV), and AI (Artificial Intelligence) module, a robot, an AR (Augmented Reality) device, a VR (Virtual Reality) device, an MR (Mixed Reality) device, a hologram device, a public safety device, an MTC device, an IoT device, a medical device, a Fin Tech device (or financial device), a security device, a climate/environment device, a device associated with 5G services, or other devices associated with the fourth industrial revolution field.

For example, a terminal or user equipment (UE) may include a cellular phone, a smart phone, a laptop computer, a digital broadcast terminal, personal digital assistants (PDAs), a portable multimedia player (PMP), a navigation device, a slate PC, a tablet PC, an ultrabook, a wearable device (e.g., a smartwatch, a smart glass and a head mounted display (HMD)), etc. For example, the HMD may be a display device worn on the head of a user. For example, the HMD may be used to realize VR, AR or MR. For example, the drone may be a flying object that flies by wireless control signals without a person therein. For example, the VR device may include a device that implements objects or backgrounds of a virtual world. For example, the AR device may include a device that connects and implements objects or background of a virtual world to objects, backgrounds, or the like of a real world. For example, the MR device may include a device that unites and implements objects or background of a virtual world to objects, backgrounds, or the like of a real world. For example, the hologram device may include a device that implements 360-degree 3D images by recording and playing 3D information using the interference phenomenon of light that is generated by two lasers meeting each other which is called holography. For example, the public safety device may include an image repeater or an imaging device that can be worn on the body of a user. For example, the MTC device and the IoT device may be devices that do not require direct interference or operation by a person. For example, the MTC device and the IoT device may include a smart meter, a bending machine, a thermometer, a smart bulb, a door lock, various sensors, or the like. For example, the medical device may be a device that is used to diagnose, treat, attenuate, remove, or prevent diseases. For example, the medical device may be a device that is used to diagnose, treat, attenuate, or correct injuries or disorders. For example, the medial device may be a device that is used to examine, replace, or change structures or functions. For example, the medical device may be a device that is used to control pregnancy. For example, the medical device may include a device for medical treatment, a device for operations, a device for (external) diagnose, a hearing aid, an operation device, or the like. For example, the security device may be a device that is installed to prevent a danger that is likely to occur and to keep safety. For example, the security device may be a camera, a CCTV, a recorder, a black box, or the like. For example, the Fin Tech device may be a device that can provide financial services such as mobile payment.

Referring to FIG. 1, the first communication device 910 and the second communication device 920 include processors 911 and 921, memories 914 and 924, one or more Tx/Rx radio frequency (RF) modules 915 and 925, Tx processors 912 and 922, Rx processors 913 and 923, and antennas 916 and 926. The Tx/Rx module is also referred to as a transceiver. Each Tx/Rx module 915 transmits a signal through each antenna 926. The processor implements the aforementioned functions, processes and/or methods. The processor 921 may be related to the memory 924 that stores program code and data. The memory may be referred to as a computer-readable medium. More specifically, the Tx processor 912 implements various signal processing functions with respect to L1 (i.e., physical layer) in DL (communication from the first communication device to the second communication device). The Rx processor implements various signal processing functions of L1 (i.e., physical layer).

UL (communication from the second communication device to the first communication device) is processed in the first communication device 910 in a way similar to that described in association with a receiver function in the second communication device 920. Each Tx/Rx module 925 receives a signal through each antenna 926. Each Tx/Rx module provides RF carriers and information to the Rx processor 923. The processor 921 may be related to the memory 924 that stores program code and data. The memory may be referred to as a computer-readable medium.

B. Signal Transmission/Reception Method in Wireless Communication System

Figure 2:
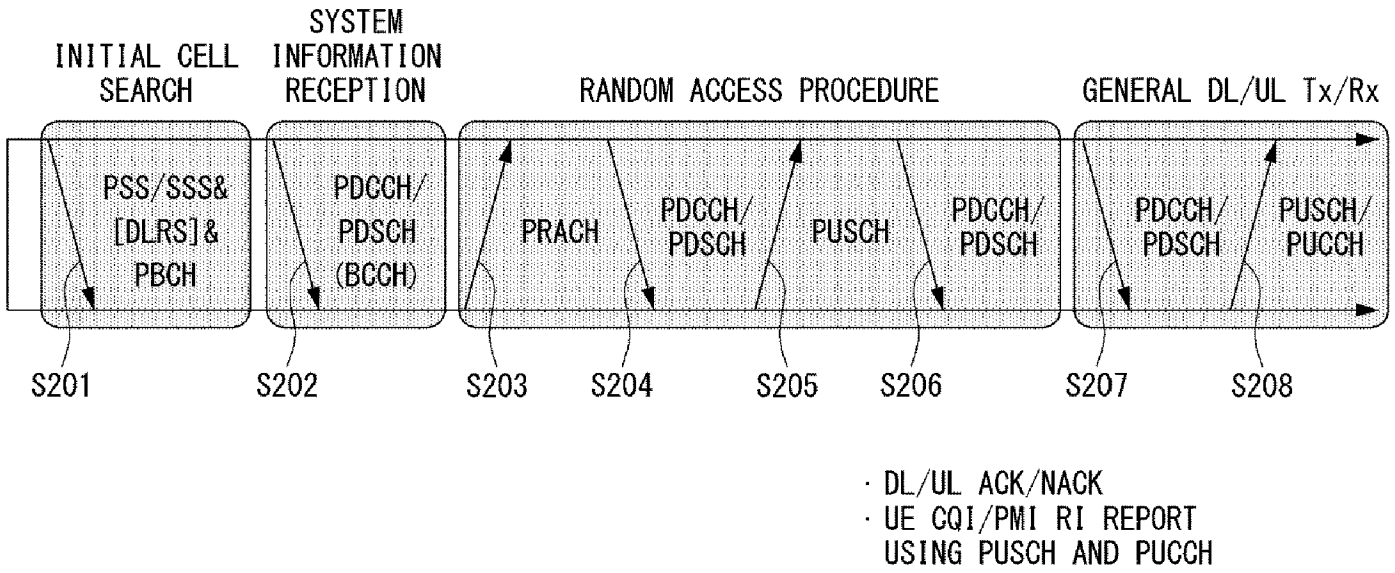
FIG. 2 shows an example of a signal transmission/reception method in a wireless communication system.

FIG. 2 is a diagram showing an example of a signal transmission/reception method in a wireless communication system.

Referring to FIG. 2, when a UE is powered on or enters a new cell, the UE performs an initial cell search operation such as synchronization with a BS (S201). For this operation, the UE can receive a primary synchronization channel (P-SCH) and a secondary synchronization channel (S-SCH) from the BS to synchronize with the BS and acquire information such as a cell ID. In LTE and NR systems, the P-SCH and S-SCH are respectively called a primary synchronization signal (PSS) and a secondary synchronization signal (SSS). After initial cell search, the UE can acquire broadcast information in the cell by receiving a physical broadcast channel (PBCH) from the BS. Further, the UE can receive a downlink reference signal (DL RS) in the initial cell search step to check a downlink channel state. After initial cell search, the UE can acquire more detailed system information by receiving a physical downlink shared channel (PDSCH) according to a physical downlink control channel (PDCCH) and information included in the PDCCH (S202).

Meanwhile, when the UE initially accesses the BS or has no radio resource for signal transmission, the UE can perform a random access procedure (RACH) for the BS (steps S203 to S206). To this end, the UE can transmit a specific sequence as a preamble through a physical random access channel (PRACH) (S203 and S205) and receive a random access response (RAR) message for the preamble through a PDCCH and a corresponding PDSCH (S204 and S206). In the case of a contention-based RACH, a contention resolution procedure may be additionally performed.

After the UE performs the above-described process, the UE can perform PDCCH/PDSCH reception (S207) and physical uplink shared channel (PUSCH)/physical uplink control channel (PUCCH) transmission (S208) as normal uplink/downlink signal transmission processes. Particularly, the UE receives downlink control information (DCI) through the PDCCH. The UE monitors a set of PDCCH candidates in monitoring occasions set for one or more control element sets (CORESET) on a serving cell according to corresponding search space configurations. A set of PDCCH candidates to be monitored by the UE is defined in terms of search space sets, and a search space set may be a common search space set or a UE-specific search space set. CORESET includes a set of (physical) resource blocks having a duration of one to three OFDM symbols. A network can configure the UE such that the UE has a plurality of CORESETs. The UE monitors PDCCH candidates in one or more search space sets. Here, monitoring means attempting decoding of PDCCH candidate(s) in a search space. When the UE has successfully decoded one of PDCCH candidates in a search space, the UE determines that a PDCCH has been detected from the PDCCH candidate and performs PDSCH reception or PUSCH transmission on the basis of DCI in the detected PDCCH. The PDCCH can be used to schedule DL transmissions over a PDSCH and UL transmissions over a PUSCH. Here, the DCI in the PDCCH includes downlink assignment (i.e., downlink grant (DL grant)) related to a physical downlink shared channel and including at least a modulation and coding format and resource allocation information, or an uplink grant (UL grant) related to a physical uplink shared channel and including a modulation and coding format and resource allocation information.

An initial access (IA) procedure in a 5G communication system will be additionally described with reference to FIG. 2.

The UE can perform cell search, system information acquisition, beam alignment for initial access, and DL measurement on the basis of an SSB. The SSB is interchangeably used with a synchronization signal/physical broadcast channel (SS/PBCH) block.

The SSB includes a PSS, an SSS and a PBCH. The SSB is configured in four consecutive OFDM symbols, and a PSS, a PBCH, an SSS/PBCH or a PBCH is transmitted for each OFDM symbol. Each of the PSS and the SSS includes one OFDM symbol and 127 subcarriers, and the PBCH includes 3 OFDM symbols and 576 subcarriers.

Cell search refers to a process in which a UE acquires time/frequency synchronization of a cell and detects a cell identifier (ID) (e.g., physical layer cell ID (PCI)) of the cell. The PSS is used to detect a cell ID in a cell ID group and the SSS is used to detect a cell ID group. The PBCH is used to detect an SSB (time) index and a half-frame.

There are 336 cell ID groups and there are 3 cell IDs per cell ID group. A total of 1008 cell IDs are present. Information on a cell ID group to which a cell ID of a cell belongs is provided/acquired through an SSS of the cell, and information on the cell ID among 336 cell ID groups is provided/acquired through a PSS.

The SSB is periodically transmitted in accordance with SSB periodicity. A default SSB periodicity assumed by a UE during initial cell search is defined as 20 ms. After cell access, the SSB periodicity can be set to one of {5 ms, 10 ms, 20 ms, 40 ms, 80 ms, 160 ms} by a network (e.g., a BS).

Next, acquisition of system information (SI) will be described.

SI is divided into a master information block (MIB) and a plurality of system information blocks (SIBs). SI other than the MIB may be referred to as remaining minimum system information. The MIB includes information/parameter for monitoring a PDCCH that schedules a PDSCH carrying SIB1 (SystemInformationBlock1) and is transmitted by a BS through a PBCH of an SSB. SIB1 includes information related to availability and scheduling (e.g., transmission periodicity and SI-window size) of the remaining SIBs (hereinafter, SIBx, x is an integer equal to or greater than 2). SiBx is included in an SI message and transmitted over a PDSCH. Each SI message is transmitted within a periodically generated time window (i.e., SI-window).

A random access (RA) procedure in a 5G communication system will be additionally described with reference to FIG. 2.

A random access procedure is used for various purposes. For example, the random access procedure can be used for network initial access, handover, and UE-triggered UL data transmission. A UE can acquire UL synchronization and UL transmission resources through the random access procedure. The random access procedure is classified into a contention-based random access procedure and a contention-free random access procedure. A detailed procedure for the contention-based random access procedure is as follows.

A UE can transmit a random access preamble through a PRACH as Msg1 of a random access procedure in UL. Random access preamble sequences having different two lengths are supported. A long sequence length 839 is applied to subcarrier spacings of 1.25 kHz and 5 kHz and a short sequence length 139 is applied to subcarrier spacings of 15 kHz, 30 kHz, 60 kHz and 120 kHz.

When a BS receives the random access preamble from the UE, the BS transmits a random access response (RAR) message (Msg2) to the UE. A PDCCH that schedules a PDSCH carrying a RAR is CRC masked by a random access (RA) radio network temporary identifier (RNTI) (RA-RNTI) and transmitted. Upon detection of the PDCCH masked by the RA-RNTI, the UE can receive a RAR from the PDSCH scheduled by DCI carried by the PDCCH. The UE checks whether the RAR includes random access response information with respect to the preamble transmitted by the UE, that is, Msg1. Presence or absence of random access information with respect to Msg1 transmitted by the UE can be determined according to presence or absence of a random access preamble ID with respect to the preamble transmitted by the UE. If there is no response to Msg1, the UE can retransmit the RACH preamble less than a predetermined number of times while performing power ramping. The UE calculates PRACH transmission power for preamble retransmission on the basis of most recent pathloss and a power ramping counter.

The UE can perform UL transmission through Msg3 of the random access procedure over a physical uplink shared channel on the basis of the random access response information. Msg3 can include an RRC connection request and a UE ID. The network can transmit Msg4 as a response to Msg3, and Msg4 can be handled as a contention resolution message on DL. The UE can enter an RRC connected state by receiving Msg4.

C. Beam Management (BM) Procedure of 5G Communication System

ABM procedure can be divided into (1) a DL MB procedure using an SSB or a CSI-RS and (2) a UL BM procedure using a sounding reference signal (SRS). In addition, each BM procedure can include Tx beam swiping for determining a Tx beam and Rx beam swiping for determining an Rx beam.

The DL BM procedure using an SSB will be described.

Configuration of a beam report using an SSB is performed when channel state information (CSI)/beam is configured in RRC_CONNECTED.

- A UE receives a CSI-ResourceConfig IE including CSI-SSB-ResourceSetList for SSB resources used for BM from a BS. The RRC parameter "csi-SSB-ResourceSetList" represents a list of SSB resources used for beam management and report in one resource set. Here, an SSB resource set can be set as {SSBx1, SSBx2, SSBx3, SSBx4, . . . }. An SSB index can be defined in the range of 0 to 63.
- The UE receives the signals on SSB resources from the BS on the basis of the CSI-SSB-ResourceSetList.
- When CSI-RS reportConfig with respect to a report on SSBRI and reference signal received power (RSRP) is set, the UE reports the best SSBRI and RSRP corresponding thereto to the BS. For example, when reportQuantity of the CSI-RS reportConfig IE is set to 'ssb-Index-RSRP', the UE reports the best SSBRI and RSRP corresponding thereto to the BS.

When a CSI-RS resource is configured in the same OFDM symbols as an SSB and 'QCL-TypeD' is applicable, the UE can assume that the CSI-RS and the SSB are quasi co-located (QCL) from the viewpoint of 'QCL-TypeD'. Here, QCL-TypeD may mean that antenna ports are quasi co-located from the viewpoint of a spatial Rx parameter. When the UE receives signals of a plurality of DL antenna ports in a QCL-TypeD relationship, the same Rx beam can be applied.

Next, a DL BM procedure using a CSI-RS will be described.

An Rx beam determination (or refinement) procedure of a UE and a Tx beam swiping procedure of a BS using a CSI-RS will be sequentially described. A repetition parameter is set to 'ON' in the Rx beam determination procedure of a UE and set to 'OFF' in the Tx beam swiping procedure of a BS.

First, the Rx beam determination procedure of a UE will be described.

- The UE receives an NZP CSI-RS resource set IE including an RRC parameter with respect to 'repetition' from a BS through RRC signaling. Here, the RRC parameter 'repetition' is set to 'ON'.
- The UE repeatedly receives signals on resources in a CSI-RS resource set in which the RRC parameter 'repetition' is set to 'ON' in different OFDM symbols through the same Tx beam (or DL spatial domain transmission filters) of the BS.
- The UE determines an RX beam thereof
- The UE skips a CSI report. That is, the UE can skip a CSI report when the RRC parameter 'repetition' is set to 'ON'.

Next, the Tx beam determination procedure of a BS will be described.

- A UE receives an NZP CSI-RS resource set IE including an RRC parameter with respect to 'repetition' from the BS through RRC signaling. Here, the RRC parameter 'repetition' is related to the Tx beam swiping procedure of the BS when set to 'OFF'.
- The UE receives signals on resources in a CSI-RS resource set in which the RRC parameter 'repetition' is set to 'OFF' in different DL spatial domain transmission filters of the BS.
- The UE selects (or determines) a best beam.
- The UE reports an ID (e.g., CRI) of the selected beam and related quality information (e.g., RSRP) to the BS. That is, when a CSI-RS is transmitted for BM, the UE reports a CRI and RSRP with respect thereto to the BS.

Next, the UL BM procedure using an SRS will be described.

- A UE receives RRC signaling (e.g., SRS-Config IE) including a (RRC parameter) purpose parameter set to 'beam management" from a BS. The SRS-Config IE is used to set SRS transmission. The SRS-Config IE includes a list of SRS-Resources and a list of SRS-ResourceSets. Each SRS resource set refers to a set of SRS-resources.

The UE determines Tx beamforming for SRS resources to be transmitted on the basis of SRS-SpatialRelation Info included in the SRS-Config IE. Here, SRS-SpatialRelation Info is set for each SRS resource and indicates whether the same beamforming as that used for an SSB, a CSI-RS or an SRS will be applied for each SRS resource.

- When SRS-SpatialRelationInfo is set for SRS resources, the same beamforming as that used for the SSB, CSI-RS or SRS is applied. However, when SRS-SpatialRelationInfo is not set for SRS resources, the UE arbitrarily determines Tx beamforming and transmits an SRS through the determined Tx beamforming.

Next, a beam failure recovery (BFR) procedure will be described.

In a beamformed system, radio link failure (RLF) may frequently occur due to rotation, movement or beamforming blockage of a UE. Accordingly, NR supports BFR in order to prevent frequent occurrence of RLF. BFR is similar to a radio link failure recovery procedure and can be supported when a UE knows new candidate beams. For beam failure detection, a BS configures beam failure detection reference signals for a UE, and the UE declares beam failure when the number of beam failure indications from the physical layer of the UE reaches a threshold set through RRC signaling within a period set through RRC signaling of the BS. After beam failure detection, the UE triggers beam failure recovery by initiating a random access procedure in a PCell and performs beam failure recovery by selecting a suitable beam. (When the BS provides dedicated random access resources for certain beams, these are prioritized by the UE). Completion of the aforementioned random access procedure is regarded as completion of beam failure recovery.

D. URLLC (Ultra-Reliable and Low Latency Communication)

URLLC transmission defined in NR can refer to (1) a relatively low traffic size, (2) a relatively low arrival rate, (3) extremely low latency requirements (e.g., 0.5 and 1 ms), (4) relatively short transmission duration (e.g., 2 OFDM symbols), (5) urgent services/messages, etc. In the case of UL, transmission of traffic of a specific type (e.g., URLLC) needs to be multiplexed with another transmission (e.g., eMBB) scheduled in advance in order to satisfy more stringent latency requirements. In this regard, a method of providing information indicating preemption of specific resources to a UE scheduled in advance and allowing a URLLC UE to use the resources for UL transmission is provided.

NR supports dynamic resource sharing between eMBB and URLLC. eMBB and URLLC services can be scheduled on non-overlapping time/frequency resources, and URLLC transmission can occur in resources scheduled for ongoing eMBB traffic. An eMBB UE may not ascertain whether PDSCH transmission of the corresponding UE has been partially punctured and the UE may not decode a PDSCH due to corrupted coded bits. In view of this, NR provides a preemption indication. The preemption indication may also be referred to as an interrupted transmission indication.

With regard to the preemption indication, a UE receives DownlinkPreemption IE through RRC signaling from a BS. When the UE is provided with DownlinkPreemption IE, the UE is configured with INT-RNTI provided by a parameter int-RNTI in DownlinkPreemption IE for monitoring of a PDCCH that conveys DCI format 2_1. The UE is additionally configured with a corresponding set of positions for fields in DCI format 2_1 according to a set of serving cells and positionInDCI by INT-ConfigurationPerServing Cell including a set of serving cell indexes provided by servingCellID, configured having an information payload size for DCI format 2_1 according to dci-Payloadsize, and configured with indication granularity of time-frequency resources according to timeFrequencySect.

The UE receives DCI format 2_1 from the BS on the basis of the DownlinkPreemption IE.

When the UE detects DCI format 2_1 for a serving cell in a configured set of serving cells, the UE can assume that there is no transmission to the UE in PRBs and symbols indicated by the DCI format 2_1 in a set of PRBs and a set of symbols in a last monitoring period before a monitoring period to which the DCI format 2_1 belongs. For example, the UE assumes that a signal in a time-frequency resource indicated according to preemption is not DL transmission scheduled therefor and decodes data on the basis of signals received in the remaining resource region.

E. mMTC (Massive MTC)

mMTC (massive Machine Type Communication) is one of 5G scenarios for supporting a hyper-connection service providing simultaneous communication with a large number of UEs. In this environment, a UE intermittently performs communication with a very low speed and mobility. Accordingly, a main goal of mMTC is operating a UE for a long time at a low cost. With respect to mMTC, 3GPP deals with MTC and NB (NarrowBand)-IoT.

mMTC has features such as repetitive transmission of a PDCCH, a PUCCH, a PDSCH (physical downlink shared channel), a PUSCH, etc., frequency hopping, retuning, and a guard period.

That is, a PUSCH (or a PUCCH (particularly, a long PUCCH) or a PRACH) including specific information and a PDSCH (or a PDCCH) including a response to the specific information are repeatedly transmitted. Repetitive transmission is performed through frequency hopping, and for repetitive transmission, (RF) retuning from a first frequency resource to a second frequency resource is performed in a guard period and the specific information and the response to the specific information can be transmitted/received through a narrowband (e.g., 6 resource blocks (RBs) or 1 RB).

F. Basic Operation of AI Processing Using 5G Communication

Figure 3:
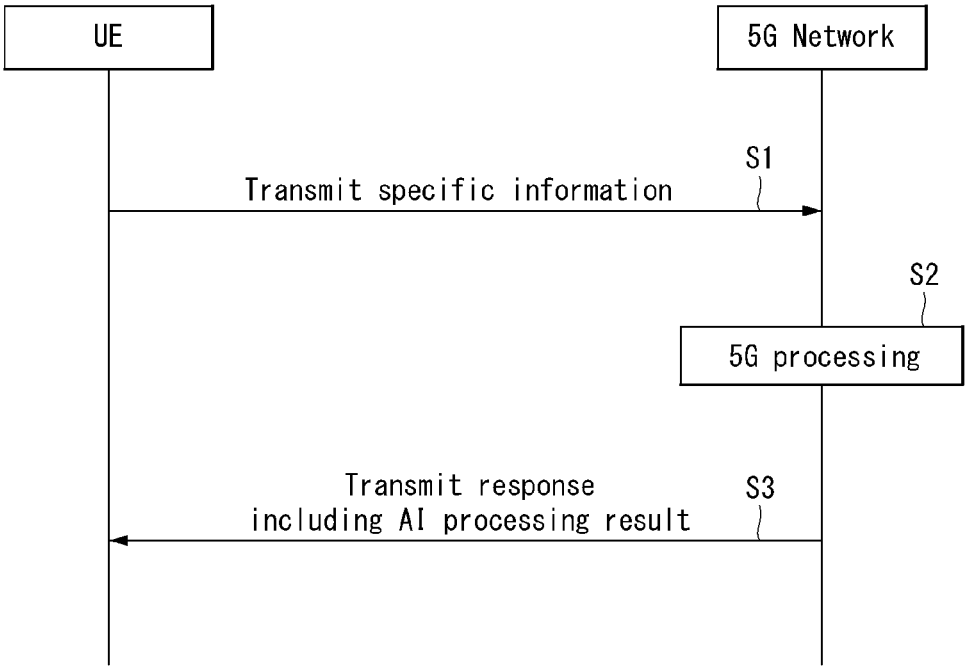
FIG. 3 shows an example of basic operations of an user equipment and a 5G network in a 5G communication system.

FIG. 3 shows an example of basic operations of AI processing in a 5G communication system.

The UE transmits specific information to the 5G network (S1). The 5G network may perform 5G processing related to the specific information (S2). Here, the 5G processing may include AI processing. And the 5G network may transmit response including AI processing result to UE(S3).

G. Applied Operations Between UE and 5G Network in 5G Communication System

Hereinafter, the operation of an autonomous vehicle using 5G communication will be described in more detail with reference to wireless communication technology (BM procedure, URLLC, mMTC, etc.) described in FIGS. 1 and 2.

First, a basic procedure of an applied operation to which a method proposed by the present disclosure which will be described later and eMBB of 5G communication are applied will be described.

As in steps S1 and S3 of FIG. 3, the autonomous vehicle performs an initial access procedure and a random access procedure with the 5G network prior to step S1 of FIG. 3 in order to transmit/receive signals, information and the like to/from the 5G network.

More specifically, the autonomous vehicle performs an initial access procedure with the 5G network on the basis of an SSB in order to acquire DL synchronization and system information. A beam management (BM) procedure and a beam failure recovery procedure may be added in the initial access procedure, and quasi-co-location (QCL) relation may be added in a process in which the autonomous vehicle receives a signal from the 5G network.

In addition, the autonomous vehicle performs a random access procedure with the 5G network for UL synchronization acquisition and/or UL transmission. The 5G network can transmit, to the autonomous vehicle, a UL grant for scheduling transmission of specific information. Accordingly, the autonomous vehicle transmits the specific information to the 5G network on the basis of the UL grant. In addition, the 5G network transmits, to the autonomous vehicle, a DL grant for scheduling transmission of 5G processing results with respect to the specific information. Accordingly, the 5G network can transmit, to the autonomous vehicle, information (or a signal) related to remote control on the basis of the DL grant.

Next, a basic procedure of an applied operation to which a method proposed by the present disclosure which will be described later and URLLC of 5G communication are applied will be described.

As described above, an autonomous vehicle can receive DownlinkPreemption IE from the 5G network after the autonomous vehicle performs an initial access procedure and/or a random access procedure with the 5G network. Then, the autonomous vehicle receives DCI format 2_1 including a preemption indication from the 5G network on the basis of DownlinkPreemption IE. The autonomous vehicle does not perform (or expect or assume) reception of eMBB data in resources (PRBs and/or OFDM symbols) indicated by the preemption indication. Thereafter, when the autonomous vehicle needs to transmit specific information, the autonomous vehicle can receive a UL grant from the 5G network.

Next, a basic procedure of an applied operation to which a method proposed by the present disclosure which will be described later and mMTC of 5G communication are applied will be described.

Description will focus on parts in the steps of FIG. 3 which are changed according to application of mMTC.

In step S1 of FIG. 3, the autonomous vehicle receives a UL grant from the 5G network in order to transmit specific information to the 5G network. Here, the UL grant may include information on the number of repetitions of transmission of the specific information and the specific information may be repeatedly transmitted on the basis of the information on the number of repetitions. That is, the autonomous vehicle transmits the specific information to the 5G network on the basis of the UL grant. Repetitive transmission of the specific information may be performed through frequency hopping, the first transmission of the specific information may be performed in a first frequency resource, and the second transmission of the specific information may be performed in a second frequency resource. The specific information can be transmitted through a narrowband of 6 resource blocks (RBs) or 1 RB.

The above-described 5G communication technology can be combined with methods proposed in the present disclosure which will be described later and applied or can complement the methods proposed in the present disclosure to make technical features of the methods concrete and clear.

Figure 4:
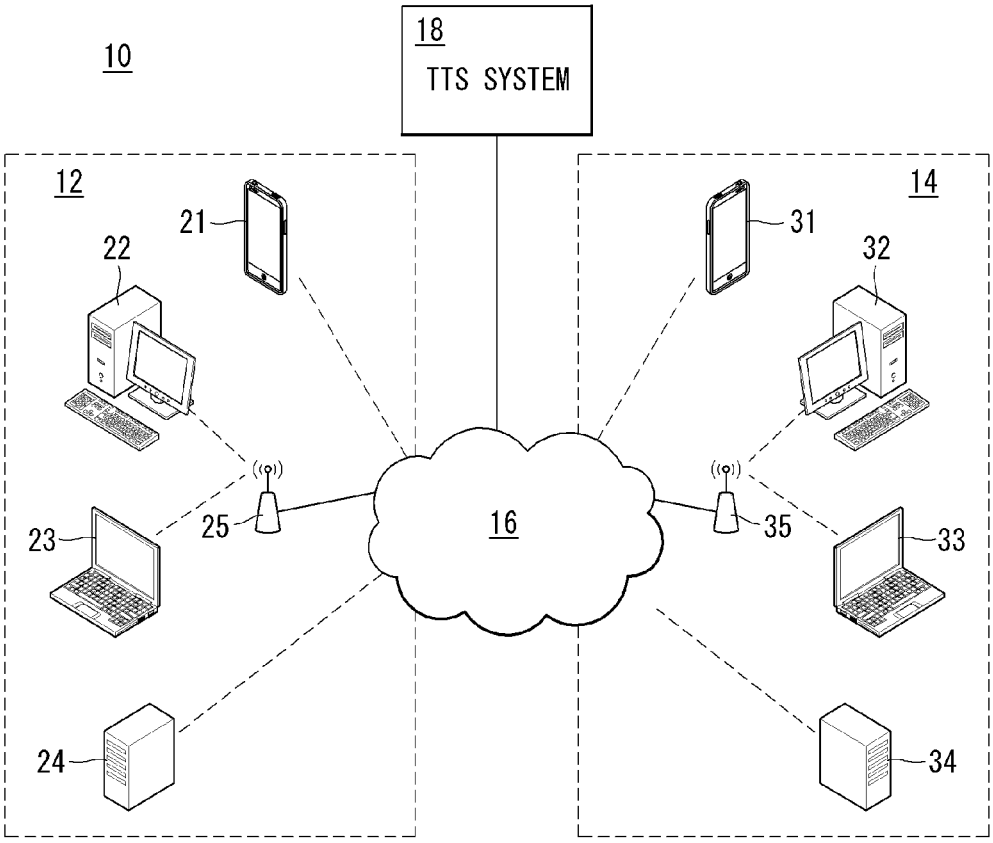
FIG. 4 is a block diagram of a communication system according to a preferred embodiment of the present disclosure.

FIG. 4 is a block diagram of a communication system according to a preferred embodiment of the present disclosure.

Referring to FIG. 4, the communication system may include at least one transmitting device 12, at least one receiving device 14, at least one network system 16 for connecting the at least one transmitting device 12 to the at least one receiving device 14, and a text-to-speech (TTS) system 18 serving as a Speech Synthesis Engine.

The at least one transmitting device 12 and the at least one receiving device 14 may include a mobile phone 21 and 31, a smart phone, a personal digital assistants (PDA), a portable multimedia player (PMP), a navigation device, an ultrabook, a wearable device (e.g., a smartwatch, a smart glass, a head mounted display (HMD)), etc.

The at least one transmitting device 12 and the at least one receiving device 14 may further include slate PCs 22 and 32, a tablet PC, laptop computers 23 and 33, etc. The slate PCs 22 and 32 and the laptop computers 23 and 33 may be connected to the at least one network system 16 via wireless access points 25 and The at one transmitting device 12 and the at least one receiving device 14 may be referred to as client devices.

Figure 5:
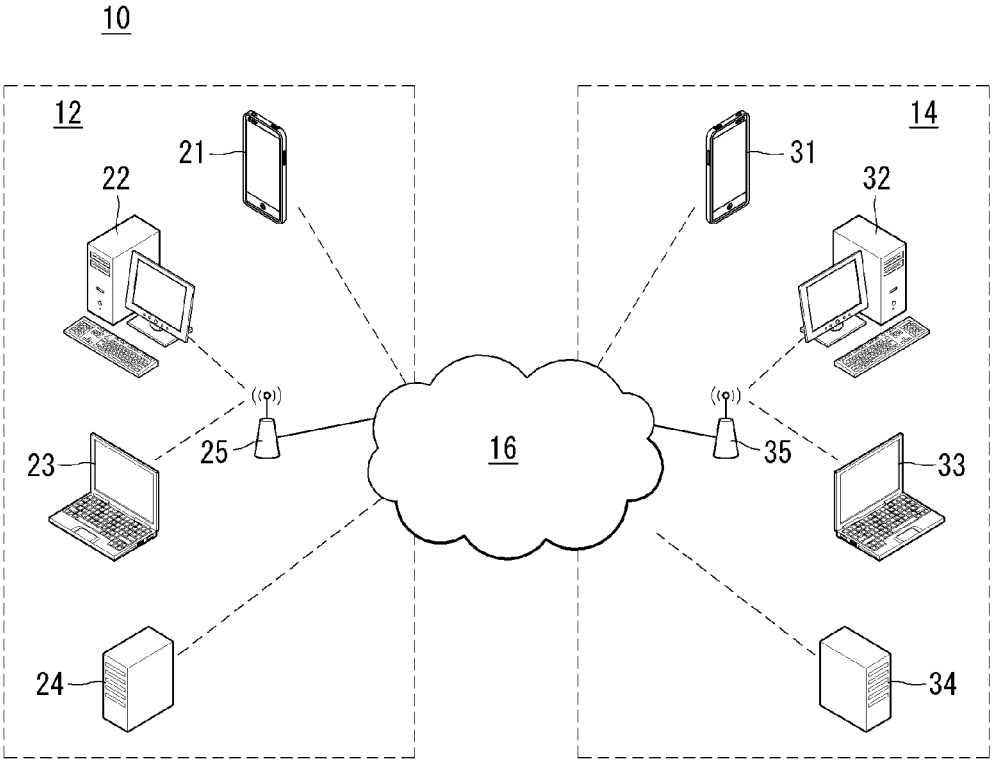
FIG. 5 is a block diagram of a communication system according to another embodiment of the present disclosure.

FIG. 5 is a block diagram of a communication system according to another embodiment of the present disclosure. The communication system shown in FIG. 5 is similar to the communication system shown in FIG. 4, except for the TTS system. An omitted TTS system may be included in the at least one transmitting device 12. That is, unlike the environment in FIG. 4, FIG. 5 shows that a TTS system is able to be implemented in the transmitting device 12 so that the TTS system can be implemented by on-device processing FIGS. 4 and 5 illustrate exemplary embodiments of the present disclosure. FIGS. 4 and 5 are to provide a context where characteristics of the present disclosure can be realized. A detailed description about one or more system architectures for implementing the system may be provided a different part of the present disclosure, an integrated application program or the like. In addition, it is preferable that each of the respective communication systems shown in FIGS. 4 and 5 includes a communication network in terms of text messaging, and it is preferable that each of the communication systems 10 shown in FIGS. 4 and 5 includes the Internet in context of instant messaging.

Figure 6:
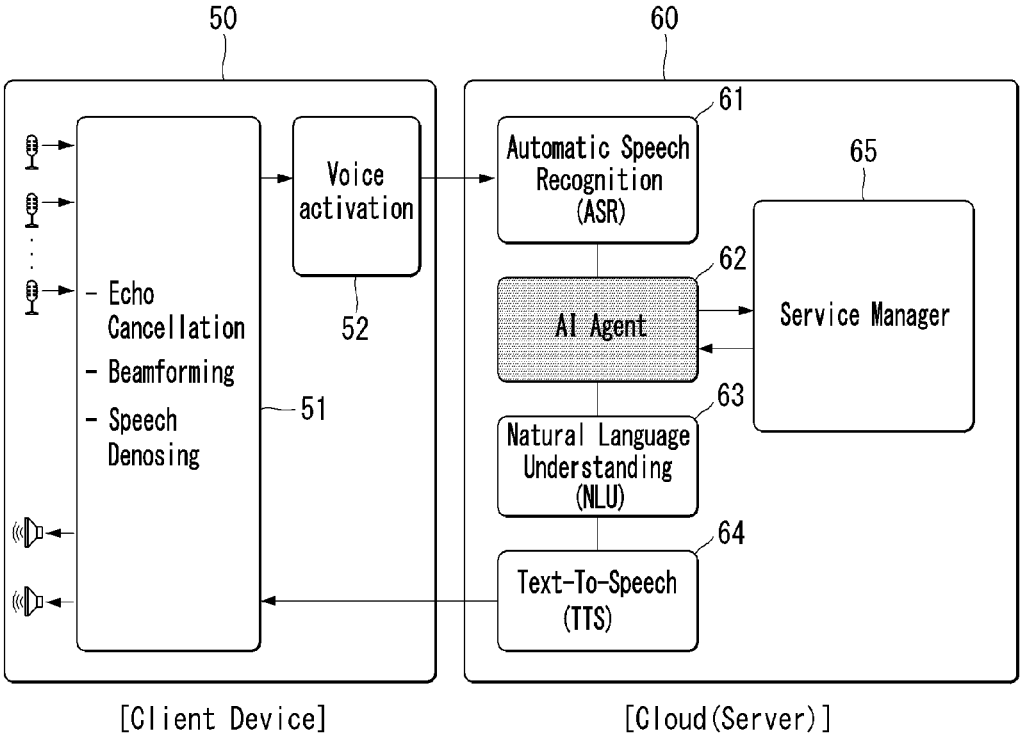
FIG. 6 shows a schematic block diagram of a text-to-speech (TTS) device in a TTS system according to an embodiment of the present disclosure.

Hereinafter, a speech processing procedure performed by a device environment and/or a cloud environment or server environment will be described with reference to FIGS. 6 and 7. FIG. 6 shows an example in which, while a speech can be received in a device 50, a procedure of processing the received speech and thereby synthesize the speech, that is, overall operations of speech synthesis, is performed in a cloud environment 60. On the contrary, FIG. 7 shows an example of on-device processing indicating that a device 70 performs the aforementioned overall operations of speech synthesis by processing a received speech and thereby synthesizing the speech.

Figure 7:
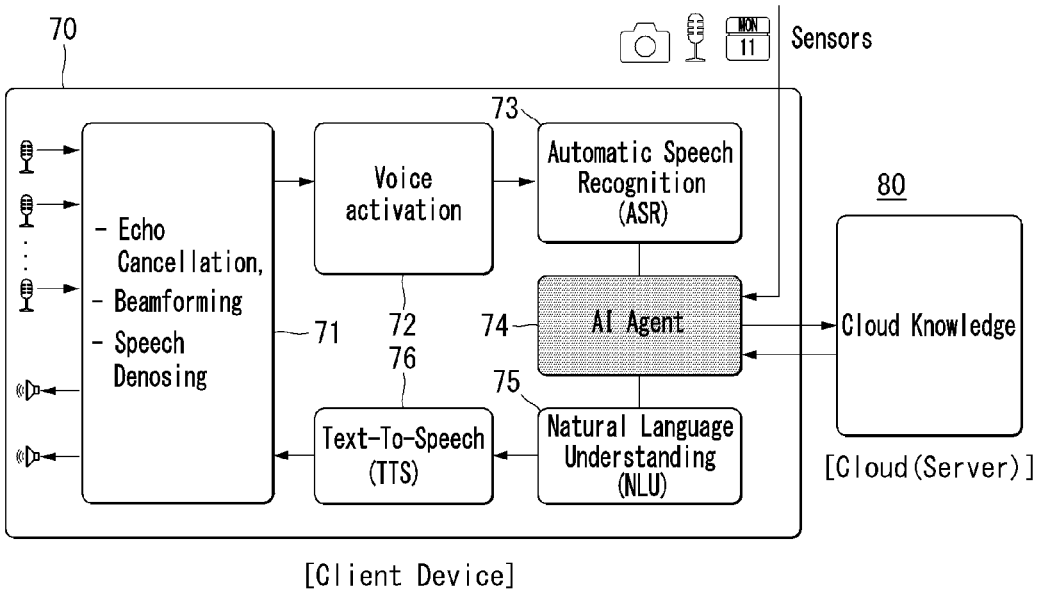
FIG. 7 is a schematic block diagram of a TTS device in a TTS system environment according to an embodiment of the present disclosure.

In FIGS. 6 and 7, the device environments 70 may be referred to as client devices, and the cloud environments 60 and 80 may be referred to as servers.

FIG. 6 shows a schematic block diagram of a text-to-speech (TTS) device in a TTS system according to an embodiment of the present disclosure.

In order to process a speech event in an end-to-end speech UI environment, various configurations are required. A sequence for processing the speech event performs signal acquisition playback, speech pre-processing, voice activation, speech recognition, natural language processing, and speech synthesis by which a device responds to a user.

The client device 50 may include an input module. The input module may receive a user input from a user. For example, the input module may receive the user input from an external device (e.g., a keyboard and a headset) connected thereto. In addition, for example, the input module may include a touch screen. In addition, for example, the input module may include a hardware key located in a user terminal.

According to an embodiment, the input module may include at least one microphone capable of receiving a user's utterance as a speech signal. The input module may include a speech input system and receive a user's speech as a speech signal through the speech input system. By generating an input signal for an audio input, the at least one microphone may determine a digital input signal for a user's speech. According to an embodiment, multiple microphones may be implemented as an array. The array may be arranged in a geometric pattern, for example, a linear geometric shape, a circular geometric shape, or a different random shape. For example, the array may be in a pattern in which four sensors are placed at 90 degrees to receive sound from four directions. In some embodiments, the microphone may include sensors of different arrays in a space of data communication, and may include a networked array of the sensors. The microphone may include an omnidirectional microphone and a directional microphone (e.g., a shotgun microphone).

The client device 50 may include a pre-processing module 51 capable of pre-processing a user input (speech signal) that is received through the input module (e.g., a microphone).

The pre-processing module 51 may include an adaptive echo canceller (AEC) function to thereby remove echo included in a user speech signal received through the microphone. The pre-processing module 51 may include a noise suppression (NS) function to thereby remove background noise included in a user input. The pre-processing module 51 may include an end-point detect (EPD) function to thereby detect an end point of a user speech and thus find out where the user speech exists. In addition, the pre-processing module 51 may include an automatic gain control (AGC) function to thereby control volume of the user speech in such a way suitable for recognizing and processing the user speech.

The client device 50 may include a voice activation module 52. The voice activation module 52 may recognize a wake-up call indicative of recognition of a user's call. The voice activation module 52 may detect a predetermined keyword (e.g., Hi LG) from a user input which has been pre-processed. The voice activation module 52 may remain in a standby state to perform an always-on keyword detection function.

The client device 50 may transmit a user voice input to a cloud server. ASR and natural language understanding (NLU) operations, which are essential to process a user speech, is generally performed in Cloud due to computing, storage, power limitations, and the like. The Cloud may include the cloud device 60 that processes a user input transmitted from a client. The cloud device 60 may exist as a server.

The cloud device 60 may include an auto speech recognition (ASR) module 61, an artificial intelligent agent 62, a natural language understanding (NLU) module 63, a text-to-speech (TTS) module 64, and a service manager 65.

The ASR module 61 may convert a user input, received from the client device 50, into textual data.

The ASR module 61 includes a front-end speech pre-processor. The front-end speech pre-processor extracts a representative feature from a speech input. For example, the front-perform a Fourier transform on the speech input to extract spectral features that characterize the speech input as a sequence of representative multi-dimensional vectors. In addition, The ASR module 61 may include one or more speech recognition modules (e.g., an acoustic model and/or a language module) and may realize one or more speech recognition engines. Examples of the speech recognition model include Hidden Markov Models, Gaussian-Mixture Models, Deep Neural Network Models, n-gram language models, and other statistical models. Examples of the speech recognition model include a dynamic time warping (DTW)-based engine and a weighted finite state transducer (WFST)-based engine. The one or more speech recognition models and the one or more speech recognition engines can be used to process the extracted representative features of the front-end speech pre-processor to produce intermediate recognitions results (e.g., phonemes, phonemic strings, and sub-words), and ultimately, text recognition results (e.g., words, word strings, or sequence of tokens).

Once the ASR module 61 generates a recognition result including a text string (e.g., words, or sequence of words, or sequence of tokens), the recognition result is transmitted to the NLP module 732 for intention deduction. In some examples, The ASR module 730 generates multiple candidate text expressions for a speech input. Each candidate text expression is a sequence of works or tokens corresponding to the speech input.

The NLU module 63 may perform a syntactic analysis or a semantic analysis to determine intent of a user. The syntactic analysis may be used to divide a user input into syntactic units (e.g., words, phrases, morphemes, or the like) and determine whether each divided unit has any syntactic element. The semantic analysis may be performed using semantic matching, rule matching, formula matching, or the like. Thus, the NLU module 63 may obtain a domain, intent, or a parameter (or a slot) necessary to express the intent from a user input through the above-mentioned analysis.

According to an embodiment, the NLU module 63 may determine the intent of the user and a parameter using a matching rule which is divided into a domain, intent, and a parameter. For example, one domain (e.g., an alarm) may include a plurality of intents (e.g., alarm setting, alarm release, and the like), and one intent may need a plurality of parameters (e.g., a time, the number of iterations, an alarm sound, and the like). The plurality of rules may include, for example, one or more mandatory parameters. The matching rule may be stored in a natural language understanding database.

According to an embodiment, the NLU module 63 may determine a meaning of a word extracted from a user input using a linguistic feature (e.g., a syntactic element) such as a morpheme or a phrase and may match the determined meaning of the word to the domain and intent to determine the intent of the user. For example, the NLU module 63 may determine the intent of the user by calculating how many words extracted from a user input are included in each of the domain and the intent. According to an embodiment, the NLU module 63 may determine a parameter of the user input using a word which is the basis for determining the intent. According to an embodiment, the NLU module 63 may determine the intent of the user using a NLU DB which stores the linguistic feature for determining the intent of the user input. According to another embodiment, the NLU module 63 may determine the intent of the user using a personal language model (PLM). For example, the NLU module 63 may determine the intent of the user using personalized information (e.g., a contact list, a music list, schedule information, social network information, etc.). For example, the PLM may be stored in, for example, the NLU DB. According to an embodiment, the ASR module 61 as well as the NLU module 63 may recognize a voice of the user with reference to the PLM stored in the NLU DB.

According to an embodiment, the NLU module 63 may further include a natural language generating module (not shown). The natural language generating module may change specified information to a text form. The information changed to the text form may be a natural language speech. For example, the specified information may be information about an additional input, information for guiding the completion of an action corresponding to the user input, or information for guiding the additional input of the user. The information changed to the text form may be displayed in a display after being transmitted to the client device or may be changed to a voice form after being transmitted to the TTS module.

The TTS module 64 may convert text input to voice output. The TTS module 64 may receive text input from the NLU module 63 of the LNU module 63, may change the text input to information in a voice form, and may transmit the information in the voice form to the client device 50. The client device 50 may output the information in the voice form via the speaker.

The speech synthesis module 64 synthesizes speech outputs based on a provided text. For example, a result generated by the ASR module 61 may be in the form of a text string. The speech synthesis module 64 may convert the text string to an audible speech output. The speech synthesis module 64 may use any appropriate speech synthesis technique in order to generate speech outputs from text, including, but not limited, to concatenative synthesis, unit selection synthesis, diphone synthesis, domain-specific synthesis, formant synthesis, articulatory synthesis, hidden Markov model (HMM) based synthesis, and sinewave synthesis.

In some examples, the speech synthesis module 64 may be configured to synthesize individual words based on phonemic strings corresponding to the words. For example, a phonemic string can be associated with a word in a generated text string. The phonemic string can be stored in metadata associated with the word. The speech synthesis model 64 may be configured to directly process the phonemic string in the metadata to synthesize the word in speech form.

Since the cloud environment generally has more processing capabilities or resources than the client device, a higher quality speech output may be acquired in synthesis on the client side. However, the present disclosure is not limited thereto, and the speech synthesis process may be performed on the client side (see FIG. 7).

Meanwhile, according to an embodiment, the client environment may further include an Artificial Intelligence (AI) agent 62. The AI agent 62 is defined to perform at least some of the above-described functions performed by the ASR module 61, the NLU module 62 and/or the TTS module 64. In addition, the AI module 62 may make contribution so that the ASR module 61, the NLU module 62 and/or the TTS module 64 perform independent functions, respectively.

The AI agent module 62 may perform the above-described functions through deep learning. The deep learning represents a certain data in a form readable by a computer (e.g., when the data is an image, pixel information is represented as column vectors or the like), and efforts are being made to conduct enormous researches for applying the representation to learning (which is about how to create better representation techniques and how to create a model that learns the better representation techniques), and, as a result, various deep learning techniques such as deep neural networks (DNN), convolutional deep neural networks (CNN), Recurrent Boltzmann Machine (RNN), Restricted Boltzmann Machine (RBM), deep belief networks (DBN), and Deep Q-Network, may be applied to computer vision, speech recognition, natural language processing, speech/signal processing, and the like.

Currently, all commercial speech recognition systems (Microsoft's Cortana, Skype translator, Google Now, Apple Siri, etc.). are based on deep learning techniques.

In particular, the AI agent module 62 may perform various natural language processes, including machine translation, emotion analysis, and information retrieval, to process natural language by use of a deep artificial neural network architecture.

Meanwhile, the cloud environment may include a service manager 65 capable of collecting various personalized information and supporting a function of the AI agent 62. The personalized information acquired through the service manager may include at least one data (a calendar application, a messaging service, usage of a music application, etc.) used through the cloud environment, at least one sensing data (a camera, a microphone, temperature, humidity, a gyro sensor, C-V2X, a pulse, ambient light, Iris scan, etc.) collected by the client device 50 and/or the cloud 60, off device data directly not related to the client device 50. For example, the personalized information may include maps, SMS, news, music, stock, weather, Wikipedia information.

For convenience of explanation, the AI agent 62 is represented as an additional block to be distinguishable from the ASR module 61, the NLU module 63, and the TTS module 64, but the AI agent 62 may perform at least some or all of the functions of the respective modules 61, 62, and 64.

In FIG. 6, an example in which the AI agent 62 is implemented in the cloud environment due to computing calculation, storage, power limitations, and the like, but the present disclosure is not limited thereto.

For example, FIG. 7 is identical to what is shown in FIG. 4, except for a case where the AI agent is included in the cloud device.

FIG. 6 is a schematic block diagram of a TTS device in a TTS system environment according to an embodiment of the present disclosure. A client device 70 and a cloud environment 80 shown in FIG. 7 may correspond to the client device 50 and the cloud device 60 aforementioned in FIG. 6, except for some configurations and functions. Accordingly, description about specific functions of corresponding blocks may refer to FIG. 6.

Referring to FIG. 7, the client device 70 may include a pre-processing module 51, a voice activation module 72, an ASR module 73, an AI agent 74, an NLU module 75, and a TTS module 76. In addition, the client device 50 may include an input module (at least one microphone) and at least one output module.

In addition, the cloud environment may include cloud knowledge 80 that stores personalized information in a knowledge form.

A function of each module shown in FIG. 7 may refer to FIG. 6. However, since the ASR module 73, the NLU module 75, and the TTS module 76 are included in the client device 70, communication with Cloud may not be necessary for a speech processing procedure such as speech recognition, speech synthesis, and the like, and thus, an instant real-time speech processing operation is possible.

Each module shown in FIGS. 6 and 7 are merely an example for explaining a speech processing procedure, and modules more or less than in FIGS. 6 and 7 may be included. In addition, two or more modules may be combined or different modules or modules with different arrangement structures may be included. The various modules shown in FIGS. 6 and 7 may be implemented in hardware, software instructions for execution by one or more processors, firmware, including one or more signal processing and/or application specific integrated circuits, or a combination thereof.

Figure 8:
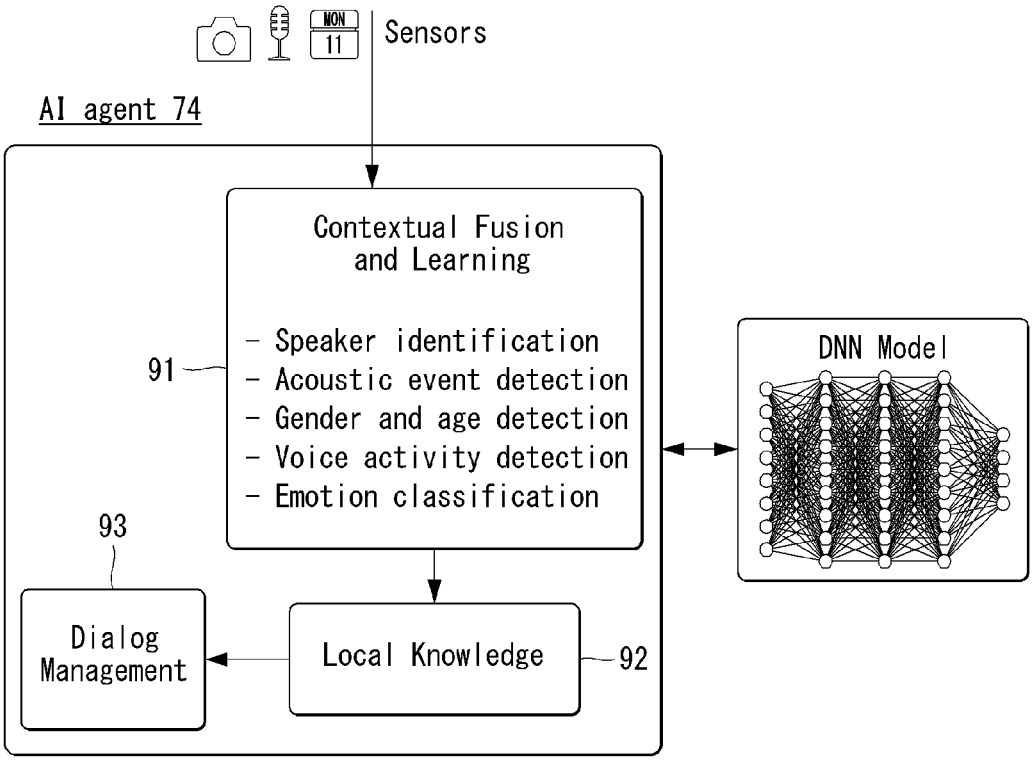
FIG. 8 is a schematic block diagram of an AI agent capable of performing emotion classification information-based TTS according to an embodiment of the present disclosure.

FIG. 8 is a schematic block diagram of an AI agent capable of performing emotion classification information-based TTS according to an embodiment of the present disclosure.

Referring to FIG. 8, in the speech processing procedure described with reference to FIGS. 6 and 7, the AI agent 74 may support an interactive operation with a user, in addition to an ASR operation, an NLU operation, and a TTS operation. Alternatively, using context information, the AI agent 74 may make contribution so that the NLU module 63 further clarify, complements, or additionally define information included in text expressions received from the ASR module 61.

Here, the context information may include preference of a user of a client device, hardware and/or software states of the client device, various types of sensor information received before, during, or after a user input, previous interactions (e.g., dialogue) between the AI agent and the user, etc. In the present disclosure, the context information is dynamic and varies depending on time, location, contents of the dialogue, and other elements.

The AI agent 74 may further include a context fusion and learning module 91, a local knowledge 92, and a dialogue management 93.

The context fusion and learning module 91 may learn a user's intent based on at least one data. The at least one data may further include at least one sensing data acquired by a client device or a cloud environment. In addition, the at least one data may further include speaker identification, acoustic event detection, a speaker's personal information (gender and age detection), voice activity detection (VAD), and emotion classification information.

The speaker identification may indicate specifying a speaker in a speaker group registered by a speech. The speaker identification may include identifying a pre-registered speaker or registering a new speaker. The acoustic event detection may outdo a speech recognition technique and may be used to recognize acoustics itself to recognize a type of sound and a place where the sound occurs. The VAD is a speech processing technique of detecting presence or absence of a human speech (voice) from an audio signal that can include music, noise, or any other sound. According to an embodiment, the AI agent 74 may detect presence of a speech from the input audio signal. According to an embodiment the AI agent 74 differentiates a speech data and a non-speech data using a deep neural networks (DNN) model. In addition, the AI agent 74 may perform emotion classification information on the speech data using the DNN model. According to the emotion classification information, the speech data may be classified as anger, boredom, fear, happiness, or sadness.

The contest fusion and learning module 91 may include a DNN model to perform the above-described operation, and may determine intent of a user input based on sensing information collected in the DNN model, the client device or the cloud environment.

The at least one data is merely an example and may include any data that can be referred to so as to determine intent of a user in a speech processing procedure. The at least one data may be acquired through the above-described DNN model.

The AI agent 74 may include the local knowledge 92. The local knowledge 92 may include user data. The user data may include a user's preference, the user's address, the user's initially set language, the user's contact list, etc. According to an embodiment, the AI agent 74 may additionally define the user's intent by complementing information included in the user's speech input using the user's specific information. For example, in response to the user's request "Invite my friends to my birthday party", the AI agent 74 does not request more clarified information from the user and may utilize the local knowledge 92 to determine who "the friends" are and when and where the "birthday" takes place.

The AI agent 74 may further include the dialogue management 93. The AI agent 74 may provide a dialogue interface to enable speech conversation with the user. The dialogue interface may refer to a procedure of outputting a response to the user's speech input through a display or a speaker. Here, a final result output through the dialogue interface may be based on the ASR operation, the NLU operation, and the TTS operation, which are described above.

Figure 9:
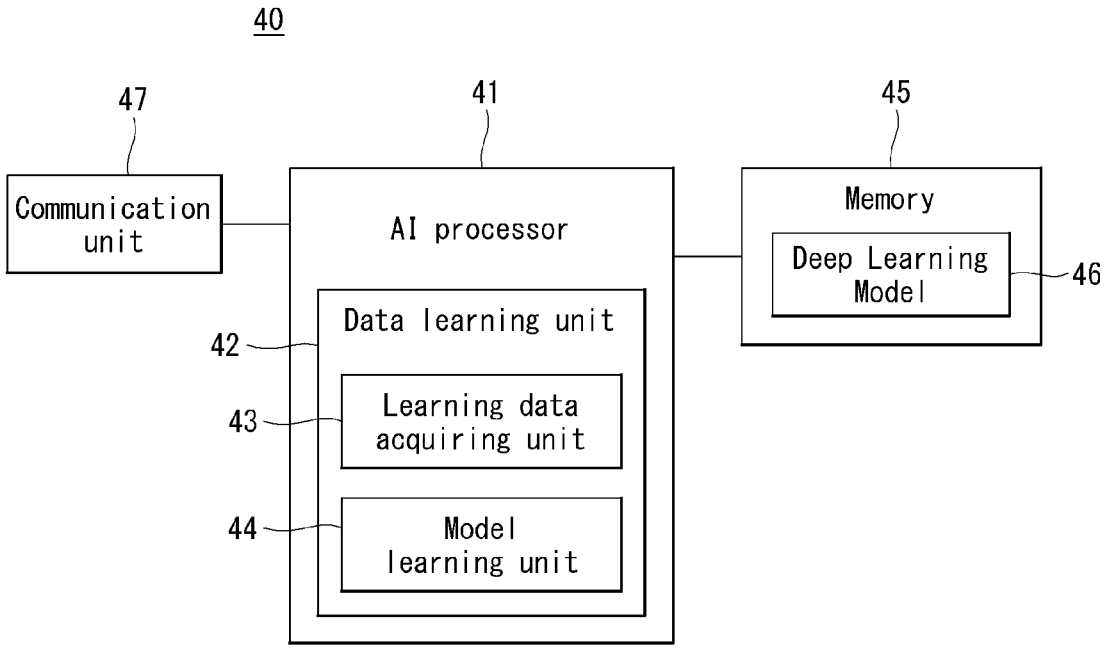
FIG. 9 is a block diagram of an AI device according to an embodiment of the present disclosure.

FIG. 9 is a block diagram of an AI device according to an embodiment of the present disclosure.

An AI device 40 may include an electronic device including an AI module that can perform AI processing, a server including the AI module, or the like. 40

The AI device 40 may include an AI processor 41, a memory 45, and/or a communication unit 47.

The AI device 40, which is a computing device that can learn a neural network, may be implemented as various electronic devices such as a server, a desktop PC, a notebook PC, and a tablet PC.

The AI processor 41 can learn a neural network using programs stored in the memory 45. In particular, the AI processor 41 can learn a neural network for recognizing data related to vehicles. Here, the neural network for recognizing data related to vehicles may be designed to simulate the brain structure of human on a computer and may include a plurality of network nodes having weights and simulating the neurons of human neural network. The plurality of network nodes can transmit and receive data in accordance with each connection relationship to simulate the synaptic activity of neurons in which neurons transmit and receive signals through synapses. Here, the neural network may include a deep learning model developed from a neural network model. In the deep learning model, a plurality of network nodes is positioned in different layers and can transmit and receive data in accordance with a convolution connection relationship. The neural network, for example, includes various deep learning techniques such as deep neural networks (DNN), convolutional deep neural networks (CNN), recurrent neural networks (RNN), a restricted boltzmann machine (RBM), deep belief networks (DBN), and a deep Q-network, and can be applied to fields such as computer vision, voice recognition, natural language processing, and voice/signal processing.

Meanwhile, a processor that performs the functions described above may be a general purpose processor (e.g., a CPU), but may be an AI-only processor (e.g., a GPU) for artificial intelligence learning.

The memory 45 can store various programs and data for the operation of the AI device 40. The memory 45 may be a nonvolatile memory, a volatile memory, a flash-memory, a hard disk drive (HDD), a solid state drive (SDD), or the like. The memory 45 is accessed by the AI processor 41 and reading-out/recording/correcting/deleting/updating, etc. of data by the AI processor 41 can be performed. Further, the memory 45 can store a neural network model (e.g., a deep learning model 26) generated through a learning algorithm for data classification/recognition according to an embodiment of the present disclosure.

Meanwhile, the AI processor 41 may include a data learning unit 442 that learns a neural network for data classification/recognition. The data learning unit 442 can learn references about what learning data are used and how to classify and recognize data using the learning data in order to determine data classification/recognition. The data learning unit 42 can learn a deep learning model by acquiring learning data to be used for learning and by applying the acquired learning data to the deep learning model.

The data learning unit 42 may be manufactured in the type of at least one hardware chip and mounted on the AI device 40. For example, the data learning unit 42 may be manufactured in a hardware chip type only for artificial intelligence, and may be manufactured as a part of a general purpose processor (CPU) or a graphics processing unit (GPU) and mounted on the AI device 40. Further, the data learning unit 42 may be implemented as a software module. When the data leaning unit 42 is implemented as a software module (or a program module including instructions), the software module may be stored in non-transitory computer readable media that can be read through a computer. In this case, at least one software module may be provided by an OS (operating system) or may be provided by an application.

The data learning unit 42 may include a learning data acquiring unit 43 and a model learning unit 44.

The learning data acquiring unit 43 can acquire learning data required for a neural network model for classifying and recognizing data. For example, the learning data acquiring unit 43 can acquire, as learning data, vehicle data and/or sample data to be input to a neural network model.

The model learning unit 44 can perform learning such that a neural network model has a determination reference about how to classify predetermined data, using the acquired learning data. In this case, the model learning unit 44 can train a neural network model through supervised learning that uses at least some of learning data as a determination reference. Alternatively, the model learning data 44 can train a neural network model through unsupervised learning that finds out a determination reference by performing learning by itself using learning data without supervision. Further, the model learning unit 44 can train a neural network model through reinforcement learning using feedback about whether the result of situation determination according to learning is correct. Further, the model learning unit 44 can train a neural network model using a learning algorithm including error back-propagation or gradient decent.

When a neural network model is learned, the model learning unit 44 can store the learned neural network model in the memory. The model learning unit 44 may store the learned neural network model in the memory of a server connected with the AI device 40 through a wire or wireless network.

The data learning unit 42 may further include a learning data preprocessor (not shown) and a learning data selector (not shown) to improve the analysis result of a recognition model or reduce resources or time for generating a recognition model.

The learning data preprocessor can preprocess acquired data such that the acquired data can be used in learning for situation determination. For example, the learning data preprocessor can process acquired data in a predetermined format such that the model learning unit 44 can use learning data acquired for learning for image recognition.

Further, the learning data selector can select data for learning from the learning data acquired by the learning data acquiring unit 43 or the learning data preprocessed by the preprocessor. The selected learning data can be provided to the model learning unit 44. For example, the learning data selector can select only data for objects included in a specific area as learning data by detecting the specific area in an image acquired through a camera of a vehicle.

Further, the data learning unit 42 may further include a model estimator (not shown) to improve the analysis result of a neural network model.

The model estimator inputs estimation data to a neural network model, and when an analysis result output from the estimation data does not satisfy a predetermined reference, it can make the model learning unit 42 perform learning again. In this case, the estimation data may be data defined in advance for estimating a recognition model. For example, when the number or ratio of estimation data with an incorrect analysis result of the analysis result of a recognition model learned with respect to estimation data exceeds a predetermined threshold, the model estimator can estimate that a predetermined reference is not satisfied.

The communication unit 47 can transmit the AI processing result by the AI processor 41 to an external electronic device.

Here, the external electronic device may be defined as an autonomous vehicle. Further, the AI device 40 may be defined as another vehicle or a 5G network that communicates with the autonomous vehicle. Meanwhile, the AI device 40 may be implemented by being functionally embedded in an autonomous module included in a vehicle. Further, the 5G network may include a server or a module that performs control related to autonomous driving.

Meanwhile, the AI device 40 shown in FIG. 9 was functionally separately described into the AI processor 41, the memory 45, the communication unit 47, etc., but it should be noted that the aforementioned components may be integrated in one module and referred to as an AI module.

Figure 10:
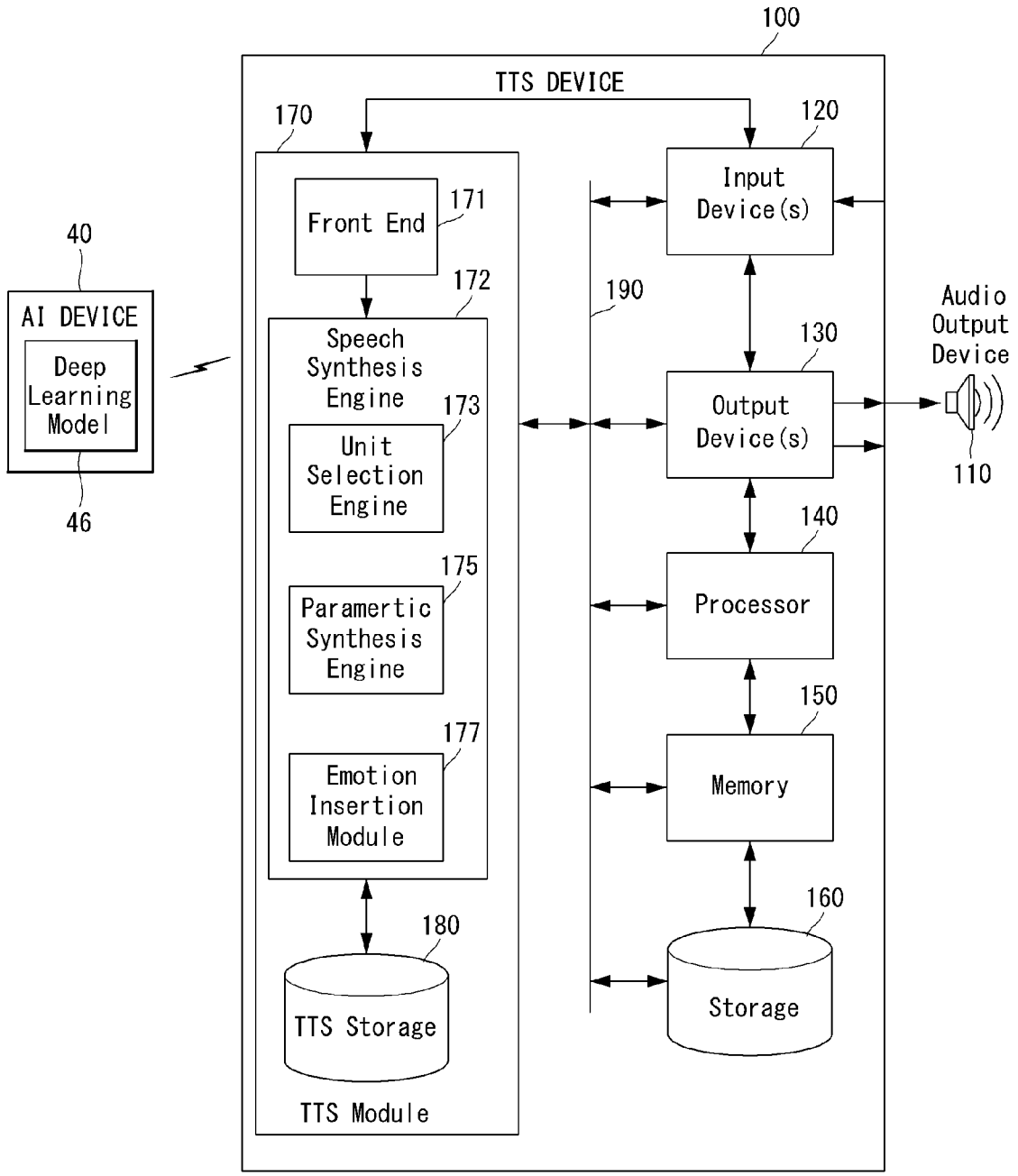
FIG. 10 is another block diagram of an emotion classification information-based TTS device according to an embodiment of the present disclosure.

FIG. 10 is another block diagram of an emotion classification information-based TTS device according to an embodiment of the present disclosure.

A TTS device 100 shown in FIG. 10 may include an audio output device 110 for outputting a speech processed by the TTS device 100 or by a different device.

FIG. 10 discloses the TTS device 100 for performing speech synthesis. An embodiment of the present disclosure may include computer-readable and computer-executable instructions that can be included in the TTS device 100. Although FIG. 10 discloses a plurality of elements included in the TTS device 100, configurations not disclosed herein may be included in the TTS device 100.

Meanwhile, some configurations disclosed in the TTS device 100 may be single configurations and each of them may be used multiple times in one device. For example, the TTS device 100 may include a plurality of input devices 120, an output device 130 or a plurality of controllers/processors 140.

A plurality of TTS devices may be applied to one TTS device. In such a multiple device system, the TTS device may include different configurations to perform various aspects of speech synthesis. The TTS device shown in FIG. 10 is merely an exemplary, may be an independent device, and may be implemented as one configuration of a large-sized device or system.

According to an embodiment of the present disclosure, a plurality of difference devices and a computer system may be, for example, applied to a universal computing system, a server-client computing system, a telephone computing system, a laptop computer, a mobile terminal, a PDA, and a tablet computer, etc. The TTS device 100 may be applied as a different device providing a speech recognition function, such as ATMs, kiosks, a Global Positioning System (GPS), a home appliance (e.g., a refrigerator, an oven, a washing machine, etc.), vehicles, ebook readers, etc. or may be applied as a configuration of the system.

Referring to FIG. 10, the TTS device 100 may include a speech output device 110 for outputting a speech processed by the TTS device 100 or by a different device. The speech output device 110 may include a speaker, a headphone, or a different appropriate configuration for transmitting a speech. The speech output device 110 may be integrated into the TTS device 100 or may be separated from the TTS device 100.

The TTS device 100 may include an address/data bus 224 for transmitting data to configurations of the TTS device 100. The respective configurations in the TTS device 100 may be directly connected to different configurations through the bus 224. Meanwhile, the respective configurations in the TTS device 100 may be directly connected to a TTS module 170.

The TTS device 100 may include a controller (processor) 140. A processor 208 may correspond to a CPU for processing data and a memory for storing computer-readable instructions to process data and storing the data and the instructions. The memory 150 may include a volatile RAM, a non-volatile ROM, or a different-type memory.

The TTS device 100 may include a storage 160 for storing data and instructions. The storage 160 may include a magnetic storage, an optical storage, a solid-state storage, etc.

The TTS device 100 may access a detachable or external memory (e.g., a separate memory card, a memory key drive, a network storage, etc.) through an input device 120 or an output device 130.

Computer instructions to be processed by the processor 140 to operate the TTS device 100 and various configurations may be executed by the processor 140 and may be stored in the memory 150, the storage 160, an external device, or a memory or storage included in the TTS module 170 described in the following. Alternatively, all or some of executable instructions may be added to software and thus embedded in hardware or firmware. An embodiment of the present disclosure may be, for example, implemented as any of various combinations of software, firmware and/or hardware.

The TTs device 100 includes the input device 120 and the output device 130. For example, the input device a microphone, a touch input device, a keyboard, a mouse, a stylus, or the audio output device 100 such as a different input device. The output device 130 may include a visual display or tactile display, an audio speaker, a headphone, a printer, or any other output device. The input device 120 and/or the output device 130 may include an interface for connection with an external peripheral device, such as a Universal Serial Bus (USB), FireWire, Thunderbolt, or a different access protocol. The input device 120 and/or the output device 130 may include a network access such as an Ethernet port, a modem, etc. The input device 120 and/or the output device may include a wireless communication device such as radio frequency (RF), infrared rays, Bluetooth, wireless local area network (WLAN) (e.g., WiFi and the like) or may include a wireless network device such as a 5G network, a long term evolution (LTE) network, a WiMAN network, and a 3G network. The TTS device 100 may include the Internet or a distributed computing environment through the input device 120 and/or the output device 130.

The TTS device 100 may include the TTS module 170 for processing textual data into audio waveforms including speeches.

The TTS module 170 may access to the bus 224, the input device 120, the output device 130, the audio output device 110, the processor 140, and/or a different configuration of the TTS device 100.

The textual data may be generated by an internal configuration of the TTS device 100. In addition, the textual data may be received from an input device such as a keyboard or may be transmitted to the TTS device 100 through a network access. A text may be a type of a sentence including a text, a number and/or a punctuation to convert into a speech by the TTS module 170. An input text may include a special annotation for processing by the TTS module 170 and may use the special annotation to indicate how a specific text is to be pronounced. The textual data may be processed in real time or may be stored or processed later on.

The TTS module 170 may include a front end 171, a speech synthesis engine 172, and a TTS storage 180. The front end 171 may convert input textual data into symbolic linguistic representation for processing by the speech synthesis engine 172. The speech synthesis engine 172 may convert input text into a speech by comparing annotated phonetic unit models and information stored in the TTS storage 180. The front end 171 and the speech synthesis engine 172 may include an embedded internal processor or memory, or may use a processor 140 included in the TTS device 100 or a memory. Instructions for operating the front end 171 and the speech synthesis engine 172 may be included in the TTS module 170, the memory 150 of the TTS device 100, the storage 160, or an external device.

Input of a text into the TTS module 170 may be transmitted to the front end 171 for a processing. The front end 171 may include a module for performing text normalization, linguistic analysis, and linguistic prosody generation.

While performing the text normalization, the front end 171 may process a text input and generate a standard text to thereby convert numbers, abbreviations, and symbols identically.

While performing the linguistic analysis, the front end 171 may generate language of a normalized text to generate a series of phonetic units corresponding to an input text. This process may be referred to as phonetic transcription. The phonetic units include symbol representation of sound units that are lastly coupled and output by the TTS device 100 as a speech. Various sound units may be used to divide a text for speech synthesis. The TTS module 170 may process a speech based on phonemes (individual acoustics), half-phonemes, di-phones (the last half of a phoneme coupled to a half of a neighboring phoneme), bi-phones (two continuous phones), syllables, words, phrases, sentences, or other units. Each word may be mapped to one or more phonetic units. Such mapping may be performed using a language dictionary stored in the TTS device 100.

Linguistic analysis performed by the front end 171 may include a process of identifying different syntactic elements, such as prefixes, suffixes, phrases, punctuations, and syntactic boundaries. Such syntactic elements may be used to output a natural audio waveform by the TTS module 170. The language dictionary may include letter-to-sound rules and other tools for pronouncing a previously unidentified word or letter combination that can be made by the TTS module 170. In general, the more the information is included in the language dictionary, the higher the quality of speech output can be ensured.

Based on the linguistic analysis, the front end 171 may generate linguistic prosody of which annotation is processed to prosodic characteristics so that phonetic units represent how final acoustic units has to be pronounced in a final output speech.

The prosodic characteristics may be referred to as acoustic features. While an operation of this step is performed, the front end 171 may integrate the acoustic features into the TTS module 170 in consideration of random prosodic annotations that accompanies a text input. Such acoustic features may include pitch, energy, duration, etc. Application of the acoustic features may be based on prosodic models that can be used by the TTS module 170. Such prosodic models represent how phonetic units are to be pronounced in a specific situation. For example, the prosodic models may take into consideration of a phoneme's position in a syllable, a syllable's position in a word, a word's position in a sentence or phrase, neighboring phonetic units, etc. Like the language dictionary, the more information on prosodic models exists, the higher the quality of speech output is ensured.

An output from the front end 171 may include a series of phonetic units which are annotation-processed into prosodic characteristics. The output from the front end 171 may be referred to as symbolic linguistic representation. The symbolic linguistic representation may be transmitted to the speech synthesis engine 172. The speech synthetic engine 172 may convert the speech into an audio wave so as to output the speech to a user through the audio output device 110. The speech synthesis engine 172 is configured to convert an input test into a high-quality natural speech in an efficient way. Such a high-quality speech may be configured to be pronounced in a similar way of a human speaker as much as possible.

The speech synthesis engine 172 may perform synthesis using at least one or more other methods.

The unit selection engine 173 compares a recorded speech database with a symbolic linguistic representation generated by the front end 171. The unit selection engine 173 matches the symbol linguistic representation and a speech audio unit in the recorded speech database. In order to form a speech output, matching units may be selected and the selected matching units may be connected to each other. Each unit includes audio waveforms, which correspond to a phonetic unit such as a short WAV file of specific sound along with description of various acoustic features associated with the WAV file (pitch, energy, etc.), and also includes other information such as a position at which the phonetic unit is represented in a word, a sentence, a phrase, or a neighboring phonetic unit.

The unit selection engine 173 may match an input text using all information in a unit database in order to generate a natural waveform. The unit database may include examples of multiple speech units that provide different options to the TTS device 100 to connect the units to a speech. One of advantages of unit selection is that a natural speech output can be generated depending on a size of the database. In addition, the greater the unit database, the more natural the speech can be constructed by the TTS device 100.

Meanwhile, speech synthesis can be performed not just by the above-described unit selection synthesis, but also by parameter synthesis. In the parameter synthesis, synthesis parameters such as frequency, volume, and noise can be varied by a parameter synthesis engine 175, a digital signal processor, or a different audio generating device in order to generate artificial speech waveforms.

The parameter synthesis may match symbolic linguistic representation with a desired output speech parameter by using an acoustic model and various statistical techniques. In the parameter synthesis, a speech can be processed even without a large-capacity database related to unit selection and a processing can be performed at a high speed. The unit selection synthesis technique and the parameter synthesis technique may be performed individually or in combination to thereby generate a speech audio output.

The parameter speech synthesis may be performed as follows. The TTS module 170 may include an acoustic model that can transform symbolic linguistic representation into a synthetic acoustic waveform of a test input based on audio signal manipulation. The acoustic model may include rules that can be used by the parameter synthesis engine 175 to allocate specific audio waveform parameters to input phonetic units and/or prosodic annotations. The rules may be used to calculate a score indicating a probability that a specific audio output parameter (frequency, volume, etc.) may correspond to input symbolic linguistic representation from the pre-processor 171.

The parameter synthesis engine 175 may apply multiple techniques to match a speech to be synthesized with an input speech unit and/or a prosodic annotation. One of general techniques employs Hidden Markov Model (HMM). The HMM may be used to determine a probability for an audio output to match a text input. In order to artificially synthesize a desired speech, the HMM may be used to convert linguistic and acoustic space parameters into parameters to be used by a vocoder (digital voice encoder).

The TTS device 100 may include a speech unit database to be used for unit selection.

The speech unit database may be stored in the TTS storage 180, the storage 160, or another storage configuration. The speech unit database may include a recorded speech voice. The speech voice may be a text corresponding to utterance contents. In addition, the speech unit database may include a recorded speech (in the form of an audio waveform, a feature factor, or another format) occupying a considerable storage space in the TTS device 100. Unit samples in the speech unit database may be classified in various ways including a phonetic unit (a phoneme, a diphone, a word, and the like), a linguistic prosody label, an acoustic feature sequence, a speaker identity, and the like.

When matching symbolic linguistic representation, the speech synthesis engine 172 may select a unit in the speech unit database that most closely matches an input text (including both a phonetic unit and a prosodic symbol annotation). In general, the large the capacity of the speech unit database, the more the selectable unit samples and thus the more accurate the speech output.

Audio waveforms including a speech output to a user may be transmitted to the audio output device 110 from the TTS module 213 so that the audio waveforms are output to a user. Audio waveforms including a speech may be stored in multiple different formats such as feature vectors, non-compressed audio data, or compressed audio data. For example, an audio output may be encoded and/or compressed by an encoder/decoder before the transmission. The encoder/decoder may encode or decode audio data such as digitalized audio data, feature vectors, etc. In addition, the function of the encoder/decoder may be included in an additional component or may be performed by the processor 140 and the TTS module 170.

Meanwhile, the TTS storage 180 may store different types of information for speech recognition.

Contents in the TTS storage 180 may be prepared for general TTS usage and may be customized to include sound and words that can be used in a specific application. For example, for TTS processing by a GPS device, the TTS storage 180 may include a customized speech specialized in position and navigation.

In addition, the TTS storage 180 may be customized to a user based on a personalized desired speech output. For example, the user may prefer an output voice of a specific gender, a specific accent, a specific speed, a specific emotion (e.g., a happy voice). The speech synthesis engine 172 may include a specialized database or model to explain such user preference.

The TTs device 100 may perform TTS processing in multiple languages. For each language, the TTS module 170 may include data, instructions, and/or components specially configured to synthesize a speech in a desired language.

For performance improvement, the TTS module 213 may modify or update contents of the TTS storage 180 based on a feedback on a TTS processing result, and thus, the TTS module 170 may improve speech recognition beyond a capability provided by a training corpus.

As the processing capability of the TTS device 100 improves, a speech output is possible by reflecting an attribute of an input text. Alternatively, although an emotion attribute is not included in the input text, the TTS device 100 may output a speech by reflecting intent (emotion classification information) of a user who has written the input text.

Indeed, when a model to be integrated into a TTS module for performing TTS processing is established, the TTS system may integrate the above-described various configurations and other configurations. For example, the TTS device 100 may insert an emotion element into a speech.

In what follows, a method for generating synthesized speech proposed in the present disclosure will be described in detail.

Conventionally, emotion-based speech synthesis methods include i) methods using emotion information and ii) methods using a style token layer.

First, i) to use a method using emotion information, emotion-based learning data have to be generated, where methods for generating emotion-based learning data may be largely divided into a) methods using recording of new speech and b) methods using existing speech. The methods for generating emotion-based learning data have some problems.

In the case of a), an actor (for example, a voice actor) reads text to be used as learning data with emotions configured for the text and records the actor's speech. In the case of b), existing speech is utilized through existing speech data, audiobooks, movies, dramas, or broadcasts. At this time, since text does not carry emotion information, a person actually listens to the spoken text and performs a process of tagging emotion information.

In the case of a), there is a problem that no method is capable of verifying whether an actor has read and recorded text with configured emotions. Similarly, in the case of b), subjective judgement by a person is involved in tagging emotion information, and therefore, when many people are involved in tagging emotion information, tagging results may not be consistent due to personal variation.

Moreover, when speech is synthesized by using the learning method of a) or b), there is a problem that it is not possible to verify whether speech has been synthesized and generated according to configured or tagged emotion information.

Next, ii) in the case of a method using a style token layer, it generates style information from input speech by using a style token layer.

At this time, a style token-based speech synthesis model determines a style through learning which utilizes the deep learning technique. Here, the style is not the one that may be determined by a developer (a user or an inputter) but is automatically generated in a random fashion as the model learns the model.

The style may have the same meaning as emotion information of synthesized speech, which has a problem that the style is generated differently for each run according to training data (text, speech, and the like).

Also, ii) when the style token layer is used, synthesized speech is generated based on a style generated by using text and reference speech. However, there is a problem that no method is capable of verifying whether the synthesized speech has been generated according to the reference speech.

In other words, in generating synthesized speech, conventional methods exhibit a problem that emotion information is not configured in a consistent manner and do not provide a method for verifying (checking) whether emotion information in the synthesized speech is the emotion information desired by the developer (user or inputter) nor provide a correction method when the emotion information is not the desired one.

Therefore, in generating synthesized speech based on emotion information, the present disclosure proposes a method for configuring emotion information in a consistent manner and generating synthesized speech by correcting emotion information of the synthesized speech.

Figure 11:
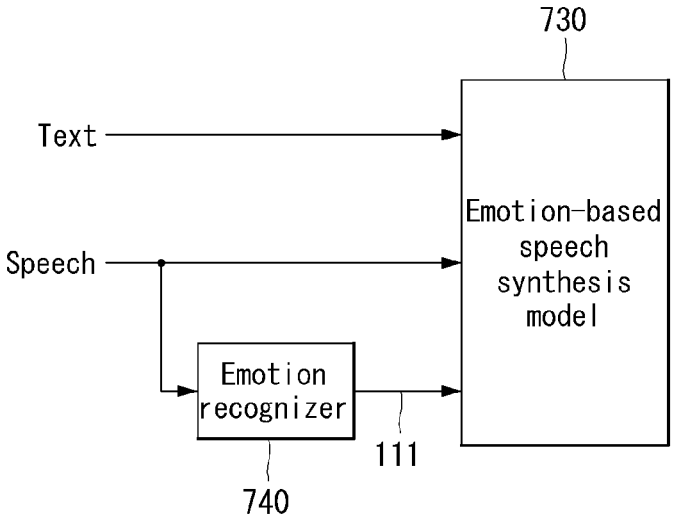
FIG. 11 shows a training method for generating synthesized speech proposed in the present disclosure.

FIG. 11 shows a training method for generating synthesized speech proposed in the present disclosure.

Referring to FIG. 11, training for synthesized speech generation is performed by using an emotion-based speech synthesis model 730.

At this time, the emotion-based speech synthesis model 730 may perform emotion-based speech synthesis by receiving three inputs of text, speech, and emotion information. Here, the emotion information refers to the emotion information included in the speech input to the emotion-based speech synthesis model 730, which may be the emotion information generated through the emotion recognizer 740 that receives the speech as an input 111.

Also, the text input to the emotion-based speech synthesis model 730 may consist of words spoken by the speech used as an input to the emotion-based speech synthesis model 730 or text expressed by sentences.

Through the training, data may be obtained and stored by matching text, which is an input to the emotion-based speech synthesis model 730, to the emotion information contained in the speech, and more accurate emotion information may be provided by learning emotion information about words or sentences included in the text. At this time, the training may be deep learning-based training.

The emotion-based speech synthesis model 730 of FIG. 11 may be the same as the speech synthesizing unit 830 to be described later or may operate as a sub-unit included in the speech synthesizing unit 830. Also, the emotion recognizer 740 may be the same as the emotion recognizing unit 840 to be described later.

Figure 12:
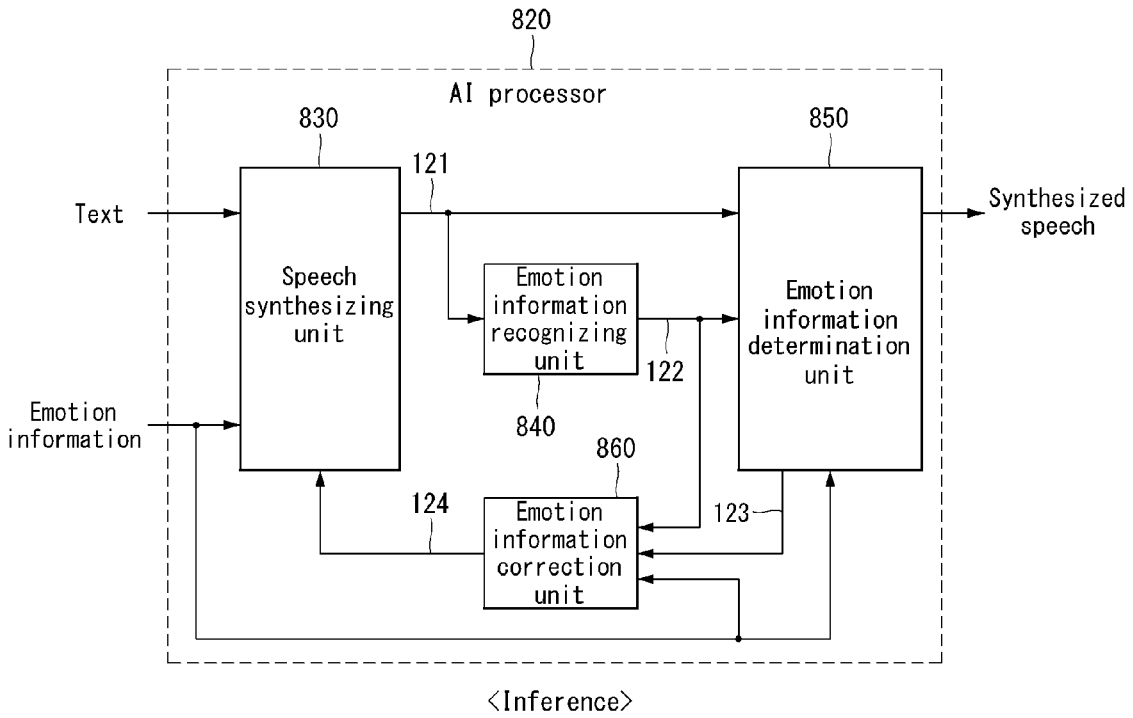
FIG. 12 shows a method for inferring synthesized speech proposed in the present disclosure.

FIG. 12 shows a method for inferring synthesized speech proposed in the present disclosure.

Referring to FIG. 12, generation of synthesized speech may be performed in the AI processor 820 or may be performed by apparatus including the AI processor 820. At this time, apparatus including the AI processor 820 may include a mobile terminal (namely, a mobile device or a smart phone) or various types of AI devices.

In what follows, a method for inferring (generating) synthesized speech will be described in detail with reference to FIG. 12.

First, a developer (user) who wants to generate synthesized speech may input text and emotion information to the speech synthesizing unit 830, and the speech synthesizing unit 830 included in the AI processor 820 may infer and generate synthesized speech by using the text and emotion information 121. At this time, the text and emotion information may be input through the input unit 810. In what follows, emotion information may be expressed as emotion information desired by the user and will be used interchangeably afterwards.

And the generated synthesized speech may be input to the emotion information recognizing unit 840 which extracts and obtains emotion information included in the generated synthesized speech 122. At this time, as described above, training and learning results for synthesized speech generation may be used.

Afterwards, the emotion information determination unit 850 takes as inputs synthesized speech generated in the step 121, emotion information generated in the step 122, and emotion information desired by the user provided through the input unit; and determines whether the emotion information generated in the step 122 matches the emotion information desired by the user (namely, the emotion information input to the speech synthesizing unit 830) by referring to a preconfigured threshold.

At this time, if it is determined that the emotion information generated in the step 122 matches the emotion information desired by the user, the emotion information determination unit 850 outputs the synthesized speech generated in the step 121. At this time, the synthesized speech may be output through the output unit 870.

Meanwhile, if it is determined that the emotion information generated in the step 122 does not match the emotion information desired by the user, the emotion information determination unit 850 transmits a re-synthesis execution command to the emotion information correction unit 860, 123.

If receiving the re-synthesis execution command from the emotion information determination unit 850, the emotion information correction unit 860 corrects the emotion information by using the emotion information generated in the step 122 and the emotion information desired by the user; and generates corrected emotion information 124.

At this time, the emotion information generated in the step 122 may be corrected, or new emotion information may be generated based on the emotion information generated in the step 122 and the emotion information desired by the user.

Afterwards, the corrected emotion information generated in the step 124 is transmitted to the speech synthesizing unit 830, and the speech synthesizing unit 830 re-performs the process for generating synthesized speech by using the corrected emotion information.

In other words, new synthesized speech is generated by using corrected emotion information generated in the step 124, and new emotion information included in the new synthesized speech is extracted and obtained, by which the process for generating synthesized speech may be performed until the emotion information determination unit 850 determines that the new emotion information matches the emotion information desired by the user. At this time, in re-performing the process for generating synthesized speech, the text and emotion information received through the input unit may be used additionally.

And if it is determined that the new emotion information matches the emotion information desired by the user, the new synthesized speech (namely, synthesized speech generated by using the corrected emotion information generated in the step 124) is output.

The emotion information described in the present disclosure may be formatted in a vector form.

In what follows, one example of a preconfigured threshold will be described, which is used for the emotion information determination unit 850 to determine whether the emotion information generated in the step 122 matches the emotion information desired by the user.

In other words, the emotion information determination unit 850 may determine whether the emotion information generated in the step 122 is the same as the emotion information desired by the user and determine whether the emotion information generated in the step 122 needs to be corrected.

In other words, whether to apply correction may be determined by checking whether a vector value of the emotion information generated in the step 122 is the same as the vector value of the emotion information desired by the user.

More specifically, loss of an emotion information vector (EV_O (emotion vector for original)) and loss of emotion information vector (EV_S (emotion vector for synthesis)) of the first synthesized speech are calculated, and if the loss is less than a preconfigured threshold (Loss<Threshold), the loss may be considered to be allowable.

At this time, to calculate the loss, various loss functions may be used. Types of loss function are shown in Eqs. 1 and 2.

$$L1\ \text{Loss(absolute difference)}=\Sigma|EV_O(i)-EV_S(i)| \quad \text{[Eq. 1]}$$

$$L2\ \text{Loss(squared difference)}=\Sigma((EV_O(i)-EVS(i))*(EV_0(i)-EV_S(i)) \quad \text{[Eq. 2]}$$

Equation 1 describes a function based on a difference between an emotion information vector (EV_O (emotion vector for original)) and an emotion information vector EV_S (emotion vector for synthesis) of the first synthesized speech.

Equation 2 describes a function based on the square of a difference between the emotion information vector (EV_O (emotion vector for original)) and the emotion information vector EV_S (emotion vector for synthesis) of the first synthesized speech.

In what follows, a method for correcting emotion information of synthesized speech proposed in the present disclosure will be described additionally.

If the emotion information determination unit 850 determines that emotion information needs to be corrected, the vector value of the emotion information desired by the user is compared with the vector value of the emotion information generated in the step 122; if the two vector values are different from each other, it may be determined that the emotion information needs to be corrected.

For example, suppose the vector of the emotion information desired by the user is [1 0 0 0 0], and the vector of the emotion information generated in the step 122 is [0.8 0.2 0 0 0]. In other words, the vector of the emotion information desired by the user and the vector of the emotion information of synthesized speech generated by using the emotion information desired by the user may be different from each other. In this case, the emotion information determination unit 850 may transmit the re-synthesis execution command of the step 123 to the emotion information correction unit 860.

In other words, if the vector of the emotion information desired by the user is the same as the vector of the emotion information generated in the step 122, it may be determined that correction is not needed.

The corrected emotion information generated in the emotion information correction unit 860 of the step 124 may correspond to emotion information when a vector of new emotion information included in new synthesized speech generated by using the corrected emotion information generated in the step 124 is the same as the vector of emotion information desired by the user; or emotion information when the vector of new emotion information is compared with the vector of emotion information desired by the user, and the preconfigured threshold is satisfied.

In other words, in the example above, emotion information may be corrected to generate new corrected emotion information so that a vector of new emotion information included in the new synthesized speech becomes [1 0 0 0 0].

Figure 13A:
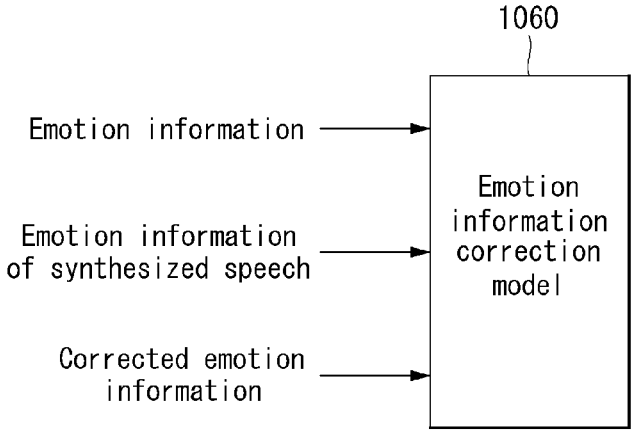
FIGS. 13A and 13B show a method for training and inferring emotion information proposed in the present disclosure.
Figure 13B:
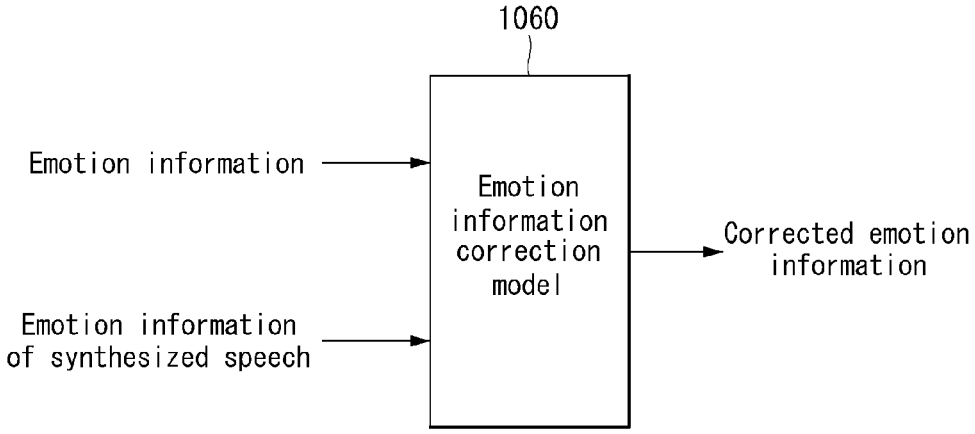

FIG. 13 shows a method for training and inferring emotion information proposed in the present disclosure, where FIG. 13(*a*) illustrates a method for training emotion information by using the emotion information correction model 1060, and FIG. 13(*b*) illustrates a method for inferring (generating) corrected emotion information by using the emotion information correction model 1060. At this time, the emotion information correction model may be the same as the emotion information correction unit 860 or may operate as a sub-unit included in the emotion information correction unit 860.

Referring to the training method for correction of emotion information, the emotion information correction model takes as inputs emotion information, emotion information of synthesized speech, and corrected emotion information; and learns and obtains emotion information. At this time, the emotion information correction model 1060 may be a deep learning model, and the corrected emotion information may be emotion information generated through the step 124.

At this time, the emotion information correction unit 860 may provide a different correction value according to the emotion-based speech learning model 730 and may learn and obtain emotion information based on the emotion-based speech learning model 730.

To infer corrected emotion information, the emotion information correction model 1060 may take emotion information and emotion information of synthesized speech as inputs and infer the corrected emotion information.

At this time, to infer the corrected emotion information, information obtained through the emotion information training may be used, and the method described above may be used as a method for inferring corrected emotion information.

Figure 14:
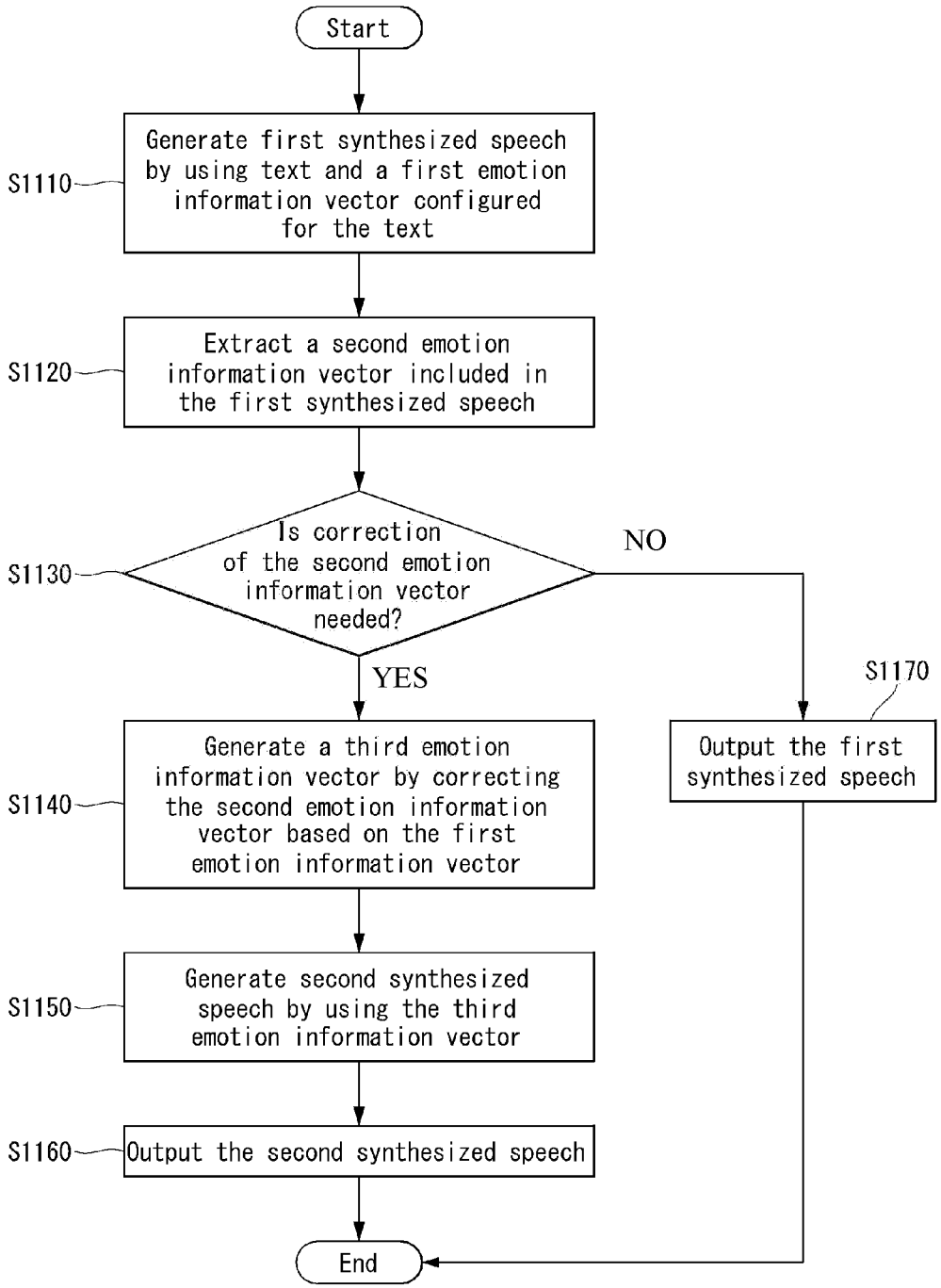
FIG. 14 is a flow diagram illustrating a method for generating synthesized speech proposed in the present disclosure.

FIG. 14 is a flow diagram illustrating a method for generating synthesized speech proposed in the present disclosure.

Referring to FIG. 14, first, first synthesized speech is generated by using text and a first emotion information vector configured for the text; and a second emotion information vector included in the first synthesized speech is extracted S1110, 1120.

And it is determined whether the second emotion information vector needs to be corrected S1130.

At this time, more specifically, the S1130 step compares loss calculated by using the first emotion information vector and the second emotion information vector with a preconfigured threshold and determines whether correction of the second emotion information vector is needed.

If it is found from the determination result in the S1130 step that the loss calculated by using the first emotion information vector and the second emotion information vector exceeds the preconfigured threshold, a third emotion information vector is generated by correcting the second emotion information vector based on the first emotion information vector, second synthesized speech is generated by using the third information vector, and the second synthesized speech is output S1140, S1150, S1160.

At this time, the loss value calculated by using the first emotion information vector and an emotion information vector included in the second synthesized speech may be less than the preconfigured threshold.

Meanwhile, if it is found from the determination result in the S1130 that the loss value calculated by using the first emotion information vector and the second emotion information vector is less than the preconfigured threshold, the first synthesized speech is output 51170.

At this time, the loss value calculated by using the first emotion information vector and the second emotion information vector may be a value calculated based on a difference between the first emotion information vector and the second information vector; and the loss value calculated by using the first emotion information vector and an emotion information vector included in the second synthesized speech may be a value calculated based on a difference between the first emotion information vector and an emotion information vector included in the second synthesized speech.

At this time, the loss value calculated by using the first emotion information vector and an emotion information vector included in the second synthesized speech may be 0.

At this time, the loss value calculated by using the first emotion information vector and the second emotion information vector may be a value calculated based on the square of a difference between the first emotion information vector and the second emotion information vector; and the loss value calculated by using the first emotion information vector and an emotion information vector included in the second synthesized speech may be a value calculated based on the square of a difference between the first emotion information vector and an emotion information vector included in the second synthesized speech.

At this time, the third emotion information vector may be generated by using a deep learning model.

The deep learning model may perform deep learning by using the first emotion information vector, second emotion information vector, and third emotion information vector.

Figure 15:
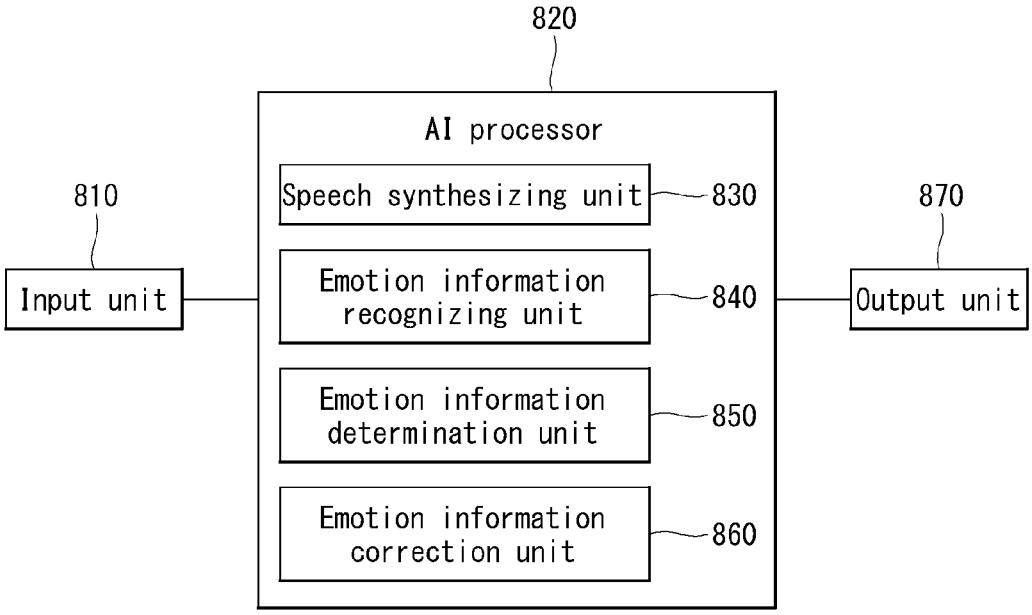
FIG. 15 is a block diagram of apparatus for generating synthesized speech proposed in the present disclosure.

FIG. 15 is a block diagram of apparatus for generating synthesized speech through emotion information correction proposed in the present disclosure.

Now, referring to FIG. 15, apparatus performing generation of synthesized speech proposed in the present disclosure will be described.

Apparatus for generating synthesized speech may include an input unit receiving text and a first emotion information vector configured for the text, an output unit outputting synthesized speech, and a processor functionally connected to the input unit and the output unit.

At this time, the processor may control the speech synthesizing unit 830 to generate first synthesized speech by using the text and the first emotion information vector configured for the text.

And the processor may control the emotion information recognizing unit 840 to extract a second emotion information vector included in the first synthesized speech.

The processor may control the emotion information determination unit 850 to compare a loss value calculated by using the first emotion information vector and the second emotion information vector with a preconfigured threshold and to determine whether the second emotion information vector needs to be corrected.

At this time, if the loss value calculated by using the first emotion information vector and the second emotion information vector exceeds the preconfigured threshold, the processor may control the emotion information correction unit 860 to generate a third emotion information vector by correcting the second emotion information vector based on the first emotion information vector.

And the processor may control the speech synthesizing unit 830 to generate second synthesized speech by using the third emotion information vector.

At this time, the output synthesized speech may be the second synthesized speech.

Meanwhile, if a loss value calculated by using the first emotion information vector and the second emotion information vector is less than the preconfigured threshold, the synthesized speech may be the first synthesized speech.

At this time, the loss value calculated by using the first emotion information vector and the second emotion information vector may be a value calculated based on a difference between the first emotion information vector and the second emotion information vector; and the loss value calculated by using the first emotion information vector and an emotion information vector included in the second synthesized speech may be a value calculated based on a difference between the first emotion information vector and an emotion information vector included in the second synthesized speech.

At this time, the loss value calculated by using the first emotion information vector and an emotion information vector included in the second synthesized speech may be 0.

At this time, the loss value calculated by using the first emotion information vector and the second emotion information vector may be a value calculated based on the square of a difference between the first emotion information vector and the second emotion information vector; and the loss value calculated by using the first emotion information vector and an emotion information vector included in the second synthesized speech may be a value calculated based on the square of a difference between the first emotion information vector and an emotion information vector included in the second synthesized speech.

At this time, the third emotion information vector may be generated by using a deep learning model.

At this time, the deep learning model may perform deep learning by using the first emotion information vector, second emotion information vector, and third emotion information vector.

Meanwhile, an electronic device including a command for performing the method for generating synthesized speech may be used.

More specifically, the electronic device may comprise one or more processors; a memory; and one or more programs, wherein the one or more programs may be configured to be stored in the memory and to be executed by the one or more processors; and the one or more programs may include commands for performing the method for generating synthesized speech.

The above-described present disclosure can be implemented with computer-readable code in a computer-readable medium in which program has been recorded. The computer-readable medium may include all kinds of recording devices capable of storing data readable by a computer system. Examples of the computer-readable medium may include a hard disk drive (HDD), a solid state drive (SSD), a silicon disk drive (SDD), a ROM, a RAM, a CD-ROM, magnetic tapes, floppy disks, optical data storage devices, and the like and also include such a carrier-wave type implementation (for example, transmission over the Internet). Therefore, the above embodiments are to be construed in all aspects as illustrative and not restrictive. The scope of the present disclosure should be determined by the appended claims and their legal equivalents, not by the above description, and all changes coming within the meaning and equivalency range of the appended claims are intended to be embraced therein.

The additional range of applicability of the present disclosure will become apparent through the detailed description below. However, since those skilled in the art will appreciate that various alterations and modifications are possible without departing from the scope of the present disclosure, embodiments disclosed herein are exemplary only and not to be considered as a limitation of the disclosure.

What is claimed is:

1. A method for generating synthesized speech, the method comprising:

generating first synthesized speech by using text and a first emotion information vector configured for the text;

extracting a second emotion information vector included in the first synthesized speech;

determining whether correction of the second emotion information vector is needed by comparing a loss value calculated by using the first emotion information vector and the second emotion information vector with a preconfigured threshold;

based on the loss value calculated by using the first emotion information vector and the second emotion information vector being less than the preconfigured threshold, outputting the first synthesized speech; and based on the loss value calculated by using the first emotion information vector and the second emotion information vector exceeding the preconfigured threshold, generating a third emotion information vector by correcting the second emotion information vector based on the first emotion information vector, generating second synthesized speech by using the third emotion information vector, and outputting the second synthesized speech, wherein a loss value calculated by using the first emotion information vector and an emotion information vector included in the second synthesized speech is less than the preconfigured threshold.

2. The method of claim 1, wherein the loss value calculated by using the first emotion information vector and the second emotion information vector is a value calculated based on a difference between the first emotion information vector and the second emotion information vector; and the loss value calculated by using the first emotion information vector and an emotion information vector included in the second synthesized speech is a value calculated based on a difference between the first emotion information vector and an emotion information vector included in the second synthesized speech.

3. The method of claim 2, wherein the loss value calculated by using the first emotion information vector and an emotion information vector included in the second synthesized speech is 0.

4. The method of claim 1, wherein the loss value calculated by using the first emotion information vector and the second emotion information vector is a value calculated based on the square of a difference between the first emotion information vector and the second emotion information vector; and the loss value calculated by using the first emotion information vector and an emotion information vector included in the second synthesized speech is a value calculated based on the square of a difference between the first emotion information vector and an emotion information vector included in the second synthesized speech.

5. The method of claim 1, wherein the third emotion information vector is generated by using a deep learning model.

6. The method of claim 5, wherein the deep learning model is a model performing deep learning by using the first emotion information vector, the second emotion information vector, and the third emotion information vector.

7. An apparatus for generating synthesized speech, the apparatus comprising:

an input unit receiving text and a first emotion information vector configured for the text;

an output unit outputting synthesized speech; and a processor functionally connected to the input unit and the output unit, wherein the processor is configured to:

generate first synthesized speech by using the text and a first emotion information vector configured for the text;

extract a second emotion information vector included in the first synthesized speech;

determine whether correction of the second emotion information vector is needed by comparing a loss value calculated by using the first emotion information vector and the second emotion information vector with a preconfigured threshold;

based on the loss value calculated by using the first emotion information vector and the second emotion information vector being less than the preconfigured threshold, output the first synthesized speech; and based on the loss value calculated by using the first emotion information vector and the second emotion information vector exceeding the preconfigured threshold, generate a third emotion information vector by correcting the second emotion information vector based on the first emotion information vector, generate second synthesized speech by using the third emotion information vector, and output the second synthesized speech, wherein a loss value calculated by using the first emotion information vector and an emotion information vector included in the second synthesized speech is less than the preconfigured threshold, and the synthesized speech is the second synthesized speech.

8. The apparatus of claim 7, wherein the loss value calculated by using the first emotion information vector and the second emotion information vector is a value calculated based on a difference between the first emotion information vector and the second emotion information vector; and the loss value calculated by using the first emotion information vector and an emotion information vector included in the second synthesized speech is a value calculated based on a difference between the first emotion information vector and an emotion information vector included in the second synthesized speech.

9. The apparatus of claim 8, wherein the loss value calculated by using the first emotion information vector and an emotion information vector included in the second synthesized speech is 0.

10. The apparatus of claim 7, wherein the loss value calculated by using the first emotion information vector and the second emotion information vector is a value calculated based on the square of a difference between the first emotion information vector and the second emotion information vector; and the loss value calculated by using the first emotion information vector and an emotion information vector included in the second synthesized speech is a value calculated based on the square of a difference between the first emotion information vector and an emotion information vector included in the second synthesized speech.

11. The apparatus of claim 7, wherein the third emotion information vector is generated by using a deep learning model.

12. The apparatus of claim 11, wherein the deep learning model is a model performing deep learning by using the first emotion information vector, the second emotion information vector, and the third emotion information vector.

13. An electronic device comprising:

one or more processors;

a memory; and one or more programs configured to be stored in the memory and to be executed by the one or more processors, the one or more programs including commands for performing the method of claim 1.

* * * * *